US007360878B2

(12) United States Patent
Takagi

(10) Patent No.: US 7,360,878 B2
(45) Date of Patent: Apr. 22, 2008

(54) INKJET PRINTER AND METHOD OF CONTROLLING THE INKJET PRINTER

(75) Inventor: Osamu Takagi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 393 days.

(21) Appl. No.: 10/974,890

(22) Filed: Oct. 28, 2004

(65) Prior Publication Data

US 2005/0093939 A1 May 5, 2005

(30) Foreign Application Priority Data

Oct. 31, 2003 (JP) ..... 2003-372363

(51) Int. Cl.
*B41J 2/175* (2006.01)

(52) U.S. Cl. ..... 347/85

(58) Field of Classification Search ..... 347/85
See application file for complete search history.

(56) References Cited

U.S. PATENT DOCUMENTS

| | | | | |
|---|---|---|---|---|
| 4,133,617 | A | 1/1979 | Reynaud | |
| 4,998,116 | A * | 3/1991 | Regnault | 347/6 |
| 6,193,354 | B1 | 2/2001 | Ito | |
| 6,447,093 | B1 * | 9/2002 | Asakawa et al. | 347/21 |
| 2002/0015069 | A1 * | 2/2002 | Yamamoto et al. | 347/21 |
| 2004/0174401 | A1 * | 9/2004 | Takagi et al. | 347/1 |
| 2004/0263558 | A1 * | 12/2004 | Seshimo | 347/30 |
| 2005/0068384 | A1 * | 3/2005 | Takagi | 347/85 |

FOREIGN PATENT DOCUMENTS

| | | |
|---|---|---|
| CH | 249478 | 6/1947 |
| DE | 1 242 100 | 6/1967 |
| EP | 1454755 A1 * | 9/2004 |
| GB | 18254 | 8/1912 |
| JP | A 57-95472 | 6/1982 |
| JP | Y2 57-58393 | 12/1982 |
| JP | A 60-2367 | 1/1985 |
| JP | B2 7-80304 | 8/1995 |
| JP | B2 2721001 | 11/1997 |
| JP | A 10-286974 | 10/1998 |
| JP | A 2001-353881 | 12/2001 |
| WO | WO 98/03794 | 1/1998 |
| WO | WO 98/42984 | 10/1998 |

OTHER PUBLICATIONS

"27.13 Cary's rotary pump 1"; New Fundamentals of Machine 10th Edition, 1977, Committee for republish of Fundamentals of Machine, Rikogakusha Publishing Co., Ltd. pp. 203.

* cited by examiner

*Primary Examiner*—Stephen Meier
*Assistant Examiner*—Rene Garcia, Jr.
(74) *Attorney, Agent, or Firm*—Oliff & Berridge, PLC

(57) ABSTRACT

A pump including a rotor is connected between a print head and an ink cartridge. A housing of the pump is provided with a suction inlet and a discharge outlet. A partition member is disposed in the rotor placed in a hollow defined in the housing. The rotor of the pump is rotated to purge ink from nozzles of the print head. Thereafter, ink is wiped off the nozzle surface of the print head by a maintenance unit. While the ink is being wiped by a maintenance unit, the rotor is rotated at a rotating speed in which ink is not ejected from the print head.

10 Claims, 20 Drawing Sheets

INKJET PRINTER AND METHOD OF CONTROLLING THE INKJET PRINTER

CROSS-REFERENCE TO RELATED APPLICATION

This application is related to U.S. patent application No. 10/790,827, filed Mar. 3, 2004. Further, this application claims priority from JP 2003-372363, filed Oct. 31, 2003, the disclosure of which is incorporated herein by reference thereto.

BACKGROUND OF THE INVENTION

1. Field of Invention

The invention relates to an inkjet printer that performs printing by ejecting ink onto a recording medium, and a method of controlling the inkjet printer.

2. Description of Related Art

For example, in FIG. 5 of Japanese Laid-Open Patent Publication No. 10-286974, which corresponds to FIG. 5 of U.S. Pat. No. 6,193,354, an inkjet printer is disclosed that includes an inkjet print head having nozzles that eject ink therefrom and an ink chamber that stores ink therein and is disposed on an opposite side of the nozzles so as to communicate with the nozzles, a cap that hermetically covers the nozzles of the print head, and a suction pump that is connected to the cap and sucks ink from the nozzles. In the ink-jet printer, with the nozzles covered by the cap, the suction pump is driven to apply negative pressure inside the cap. Therefore, air bubbles in the ink chamber may be removed together with ink by suction.

In the inkjet printer disclosed in FIG. 5 of Japanese Laid-Open Patent Publication No. 10-286974, which corresponds to FIG. 5 of U.S. Pat. No. 6,193,354, when suction with the suction pump is temporarily stopped, air bubbles, which have been suctioned into the cap, may possibly flow back to the inkjet print head immediately upon stopping the suction. In this case, even when the cap is removed from the inkjet print head after the suction, air bubbles may remain inside the inkjet print head and, in addition to air bubbles, dust and other foreign materials may flow back into the print head, resulting in ink ejection failures.

To solve the above-described problem, Japanese Laid-Open Patent Publication No. 10-286974, which corresponds to U.S. Pat. No. 6,193,354, discloses an inkjet printer including a mechanism that moves an ink tank up and down. The ink tank is maintained at a position where a level or surface of ink in the ink tank is above a nozzle surface of the print head, at least until the cap is separated from the print head after the end of the suction. Thus, air bubbles suctioned into the cap are prevented from flowing back into the print head.

SUMMARY OF THE INVENTION

Disclosed herein are an improved inkjet printer that prevents or reduces backflow of ink after ink ejection and a method for controlling the inkjet printer.

An inkjet printer for ejecting ink may include an ink tank for storing the ink therein, a print head that ejects the ink therefrom, a pump that includes a housing having a hollow interior, the housing being formed with an ink suction inlet through which the hollow interior and the ink tank communicate with each other and an ink discharge outlet through which the hollow interior and the print head communicate with each other, a rotor rotatably disposed in the hollow interior, and a partition member that is supported by the rotor and rotatable together with the rotor, two ends of the partition member contacting a wall surface defining the hollow interior, a pump drive mechanism that rotates the rotor of the pump, and a control unit that performs a first control for controlling the pump drive mechanism to rotate the rotor at a rotating speed in which ink is supplied from the ink tank to the print head through the pump and ejected from the print head, and a second control for controlling the pump drive mechanism to rotate the rotor at a rotating speed in which ink is not ejected from the print head. With such a structure, after ink is ejected, backflow of the ink may be prevented or reduced. Therefore, the entry of dust, air bubbles and/or other contaminants, which are trapped in the ink, into the print head can be prevented, and ink ejection failure may be prevented.

The inkjet printer may further include a removing unit that removes the ink adhered to an ink ejection surface of the print head and a movement mechanism that moves the print head and the removing unit relative to each other. The control unit may perform a third control for controlling the movement mechanism to move the print head and the removing unit relative to each other to remove the ink adhered to the ink ejection surface of the print head by the removing unit. The control unit may perform the second control while performing the third control. With such a structure, when ink adhered to the ink ejection surface is removed after ink ejection, backflow of the ink may be prevented or reduced.

An inkjet printer for ejecting ink may include an ink tank for storing the ink therein, a print head that ejects the ink therefrom, a pump that includes a housing having a hollow interior, the housing being formed with an ink suction inlet through which the hollow interior and the ink tank communicate with each other and an ink discharge outlet through which the hollow interior and the print head communicate with each other, a rotor rotatably disposed in the hollow interior, and a partition member that is supported by the rotor and rotatable together with the rotor, two ends of the partition member contacting a wall surface defining the hollow interior, a pump drive mechanism that rotates the rotor of the pump, and a control unit that performs a first control for controlling the pump drive mechanism to rotate the rotor at a rotating speed in which ink is supplied from the ink tank to the print head through the pump and ejected from the print head, and a second control for controlling the pump drive mechanism to stop the partition member at a position where flow resistance in a passage from the ink suction inlet to the ink discharge outlet becomes greater than that during printing. With such a structure, ink flow into the pump may be prevented and backflow of ink into the print head after ink ejection may be prevented or reduced.

A method for controlling an inkjet printer including an ink tank for storing the ink therein, a print head that ejects the ink therefrom, and a pump that includes a housing having a hollow interior, the housing being formed with an ink suction inlet through which the hollow interior and the ink tank communicate with each other and an ink discharge outlet through which the hollow interior and the print head communicate with each other, a rotor rotatably disposed in the hollow interior, and a partition member that is supported by the rotor and rotatable together with the rotor, two ends of the partition member contacting a wall surface defining the hollow interior, may include a first step for rotating the rotor at a rotating speed in which ink is supplied from the ink tank to the print head through the pump and ejected from the print head, and a second step for rotating the rotor at a rotating speed in which ink is not ejected from the print head. With such a method, after ink is ejected, backflow of the ink into the print head may be prevented or reduced.

A method for controlling an inkjet printer including an ink tank for storing the ink therein, a print head that ejects the ink therefrom, and a pump that includes a housing having a hollow interior, the housing being formed with an ink suction inlet through which the hollow interior and the ink tank communicate with each other and an ink discharge outlet through which the hollow interior and the print head communicate with each other, a rotor rotatably disposed in the hollow interior, and a partition member that is supported by the rotor and rotatable together with the rotor, two ends of the partition member contacting a wall surface defining the hollow interior, may include a first step for rotating the rotor at a rotating speed in which ink is supplied from the ink tank to the print head through the pump and ejected from the print head, and a second step for stopping the partition member at a position where flow resistance in a passage from the ink suction inlet to the ink discharge outlet becomes greater than that during printing. With such a method, ink flow into the pump may be prevented and backflow of ink into the print head after ink ejection may be prevented or reduced.

In the method for controlling an inkjet printer, the partition member may be stopped between the ink suction inlet and the ink discharge outlet in the second step. Thus, backflow of the ink may be reliably prevented or reduced.

BRIEF DESCRIPTION OF THE DRAWINGS

An exemplary embodiment of the invention will be described in detail with reference to the following figures, wherein.

DETAILED DESCRIPTION OF PREFERRED EMBODIMENTS

Figure 1:
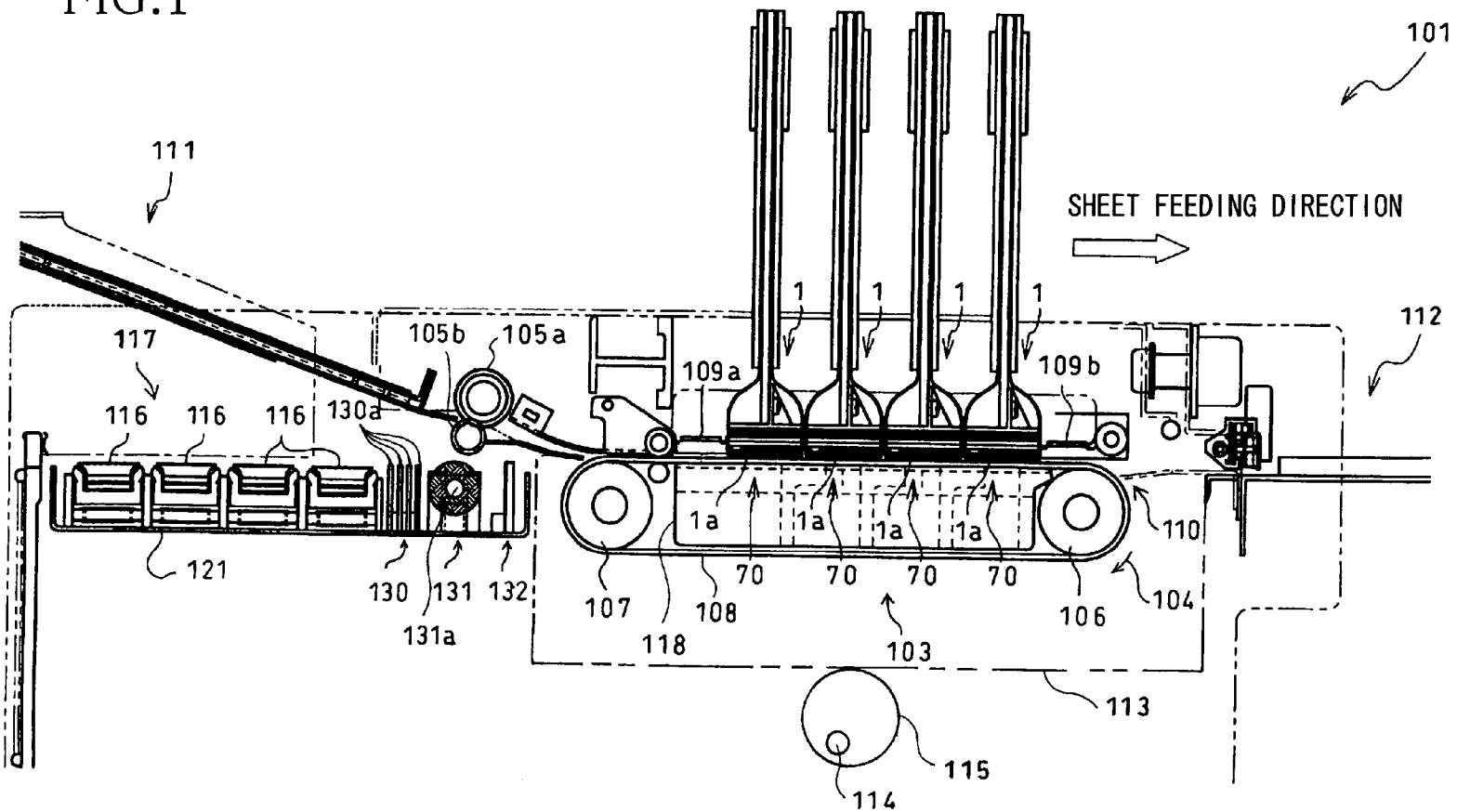
FIG. 1 is a side view showing a general structure of an inkjet printer according to an exemplary embodiment of the invention.

An exemplary embodiment of the invention will be described in detail with reference to the accompanying drawings. A general structure of an inkjet printer 101 will be described with reference to FIG. 1. The inkjet printer 101 shown in FIG. 1 is a color inkjet printer having four inkjet print heads 1. The printer 101 is provided with a sheet supply unit 111 on the left of FIG. 1 and a sheet discharge unit 112 on the right.

Inside the printer 101, a sheet feeding path is formed from the sheet supply unit 111 toward the sheet discharge unit 112. Disposed downstream of the sheet supply unit 111 are a pair of feed rollers 105*a*, 105*b* that feed a recording medium, a sheet, while holding the sheet between the feed rollers 105*a*, 105*b*. The sheet is conveyed by the pair of feed rollers 105*a*, 105*b* in a sheet feeding direction from left to right in FIG. 1. Disposed in the middle of the sheet feeding path is a belt conveyor mechanism 103 that includes two belt rollers 106, 107 and a conveyor belt 108, which is an endless loop around the two belt rollers 106, 107. An outer surface (a conveying surface) of the conveyor belt 108 is treated with silicone, to provide adhesive force. While being held on the conveying surface of the conveyor belt 108 by its adhesive force, the sheet is conveyed downstream (rightward in FIG. 1) with the belt roller 106 rotated by a conveyor drive motor 142 (shown in FIG. 5) in a clockwise direction, as indicated by an arrow 104.

Pressing members 109*a*, 109*b* are disposed on opposite sides of the belt roller 106 with respect to the sheet feeding direction. The pressing members 109*a*, 109*b* are used to bring a sheet into intimate contact with the conveying surface of the conveyor belt 108 by pressing the sheet against the conveying surface, so that the sheet is not raised from the conveying surface.

A sheet separation mechanism 110 is disposed downstream of the conveyor belt 108 in the sheet feeding direction. The sheet separation mechanism 110 is designed to separate the sheet from the conveying surface of the conveyor belt 108 and convey the sheet toward the sheet discharge unit 112.

The printer 101 is a so-called line printer with the four print heads 1 corresponding to the four color inks (magenta, yellow, cyan, and black) arranged along the sheet feeding direction. Each of the print heads 1 has a rectangular shape having a longitudinal direction perpendicular to the sheet feeding direction when viewed in a plan view. Each print head 1 includes a head body 70 on a lower end thereof. The head body 70 includes a reservoir unit 401 (in FIG. 18), a passage unit 402 (in FIG. 18) that communicates with the reservoir unit 401, and an actuator (not shown) affixed to the passage unit 402. An ink passage, including pressure chambers, is formed in the passage unit 402. The actuator applies pressure to ink in the pressure chambers. The head body 70 has, on a bottom surface thereof, a plurality of ejection nozzles having very minute diameters through which ink is ejected downward. The bottom surface of the print head 1 is hereinafter referred to as the "nozzle surface 1*a*".

The print heads 1 are arranged so as to create a small clearance between the nozzle surfaces (ink ejection surface) 1*a* of the print heads 1 and the conveying surface of the conveyor belt 108. Thus, the sheet feeding path is formed in the clearance. With this structure, while the sheet, conveyed on the conveyor belt 108, passes under the head bodies 70 of the four print heads 1, each color ink is ejected from the ejection nozzles onto an upper surface (print surface) of the sheet. Thus, a desired color image is formed on the sheet. The head body 70 is provided with a pressure sensor 12 (in FIG. 5) that measures ink pressure in the head body 70.

The belt conveyor mechanism 103, provided with the belt rollers 106, 107 and the conveyor belt 108, is supported by an elevator mechanism including a chassis 113. While a maintenance unit 117, which will be described in detail below, is moved horizontally, the belt conveyor mechanism 103 is moved up or down by the elevator mechanism.

Figure 6:
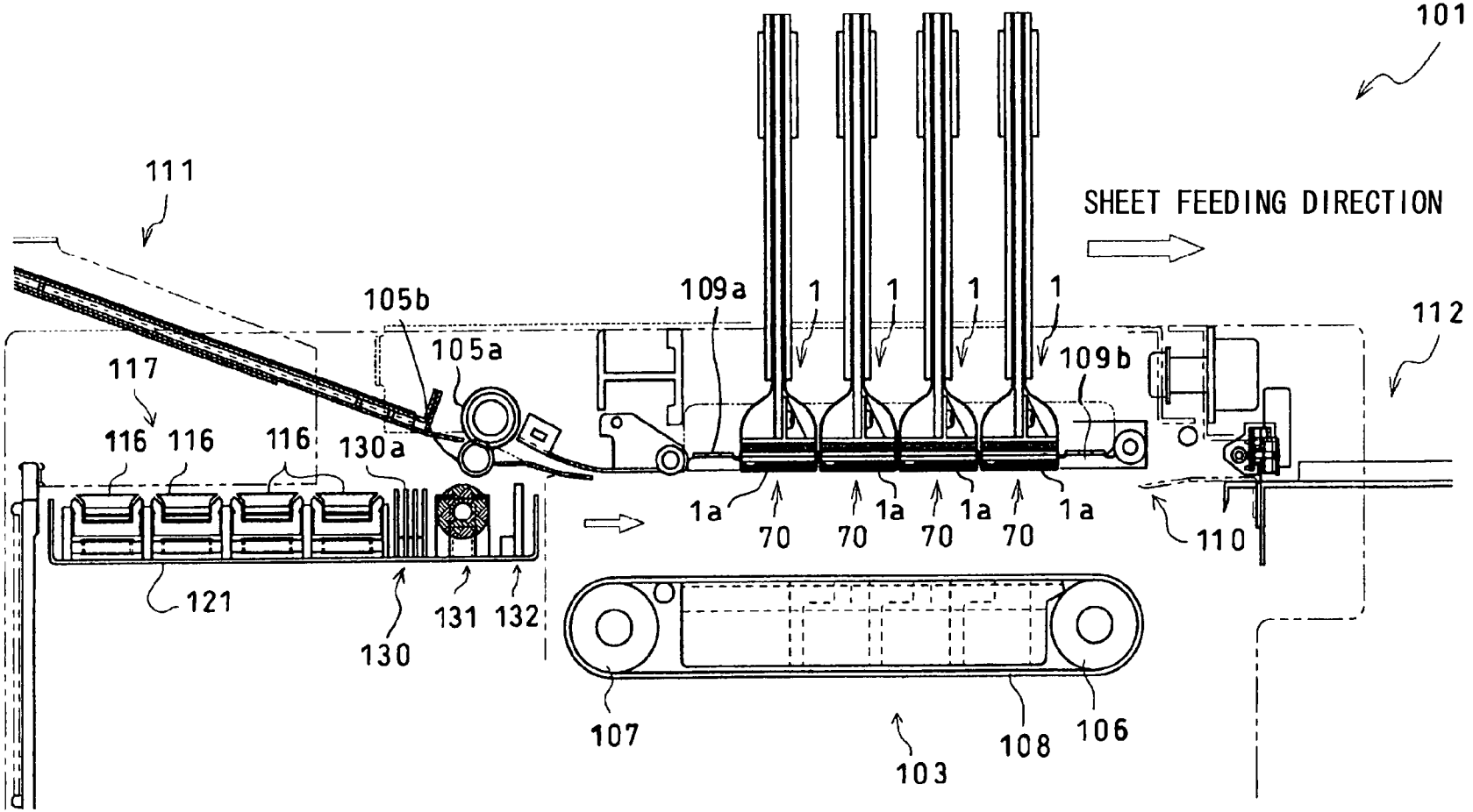
FIG. 6 is a side view of the inkjet printer showing a position of a belt transfer mechanism moved at the start of a maintenance operation.

The chassis 113 of the elevator mechanism is disposed on a cylindrical member 115 positioned below the chassis 113. The cylindrical member 115 is rotatable about a shaft 114 disposed at a position shifted from the center of the cylindrical member 115. In accordance with the rotation of the shaft 114, levels of the upper edge of the cylindrical member 115 are changed, so that the chassis 113 is moved up or down. When the maintenance unit 117 is horizontally moved, the cylindrical member 115 is rotated by a required angle, to lower the chassis 113, the conveyor belt 108, and the belt rollers 106, 107 by a predetermined distance from the position shown in FIG. 1. Thus, a space for the movement of the maintenance unit 117 is provided, as shown in FIG. 6.

A guide member 118 is disposed in an area enclosed with the conveyor belt 108. The guide member 118 has a substantially rectangular parallelepiped shape (having a width as nearly the same as the conveyor belt 108) and is placed opposite the print heads 1 in contact with a lower surface of an upper portion of the conveyor belt 108, thereby supporting the conveyor belt 108 from the inner surface of the conveyor belt 108.

The structure of the maintenance unit 117 will be described in detail below. The maintenance unit 117 is disposed in the inkjet printer 101 for performing maintenance of the print heads 1. The maintenance unit 117 includes a frame 121 that is movable in the horizontal direction. In the frame 121, a blade (wiper) 132, a wiping roller 131, an ink absorbing member 130, and caps 116 are disposed in this order from the side nearest (right to left as viewed in FIG. 1) to the print heads 1. The blade 132, the wiping roller 131, the ink absorbing member 130, and the caps 116 form a removing unit that removes ink adhered to the nozzle surfaces 1*a*. Four caps 116 are arranged in the horizontal direction in FIG. 1 to cover corresponding nozzle surfaces 1*a* of the print heads 1. Each cap 116 has a substantially rectangular shape extending along the longitudinal direction of the print head 1 when viewed in a plan view. The cap 116 is formed of, for example, an elastic material, such as rubber, to make intimate contact with the nozzle surface 1*a* of the print head 1 and to maintain hermeticity in the cap 116. Each cap 116 has an ink outlet (not shown). Ink ejected from the print head 1 by purging with a pump 30 (described below) is discharged through the ink outlet, to a waste ink reservoir (not shown), where the discharged ink is absorbed and stored.

The ink absorbing member 130 is slightly longer than the length of the print heads 1 transverse to the sheet feeding direction. The ink absorbing member 130 includes a plurality of elongated plates 130*a* (FIG. 2) that stand vertical to the sheet feeding direction. The plates 130*a* are arranged along the sheet feeding direction, such that the adjacent plates 130*a* face each other in a direction of a shorter side of the print head 1.

The wiping roller 131 is of a substantially cylindrical shape. The wiping roller 131 is rotatably supported by a shaft 131*a* disposed parallel to the nozzle surface 1*a*. Similar to the plates 130*a*, the wiping roller 131 is slightly longer than the length of the print head 1 transverse to the sheet feeding direction. The wiping roller 131 is formed of a porous material that can absorb ink, such as urethane.

The blade 132 is slightly longer than the length of the print head 1, similar to the plates 130*a* and the wiping roller 131, and disposed along the direction transverse to the sheet feeding direction. The blade 132 is formed of flexible material, such as rubber.

When a maintenance operation is not performed, the maintenance unit 117 is in a standby position, as shown in FIG. 1, where the maintenance unit 117 is some distance from the print heads 1. At the standby position, the caps 116, the ink absorbing member 130, the wiping roller 131, and the blade 132 are disposed in the frame 121, such that upper ends thereof are disposed at a level slightly lower than the nozzle surfaces 1*a* of the print heads 1, to prevent their upper ends from contacting the nozzle surfaces 1*a* when the four caps 116 horizontally move from the standby position to a purge position where the caps 116 face the relevant nozzle surfaces 1*a* of the print heads 1.

The frame 121 is only movable in the horizontal direction (leftward and rightward directions in FIG. 1) and does not move in the vertical direction, so that the frame 121 is maintained at a constant height. The caps 116, the ink absorbing member 130, the wiping roller 131, and the blade 132 disposed in the frame 121 are movable in the vertical direction relative to the frame 121. When the maintenance operation is performed as will be described in detail, the distance between the nozzle surfaces 1*a* and the caps 116, the ink absorbing member 130, the wiping roller 131, and the blade 132 in the frame 121 is changed as required.

Figure 2:
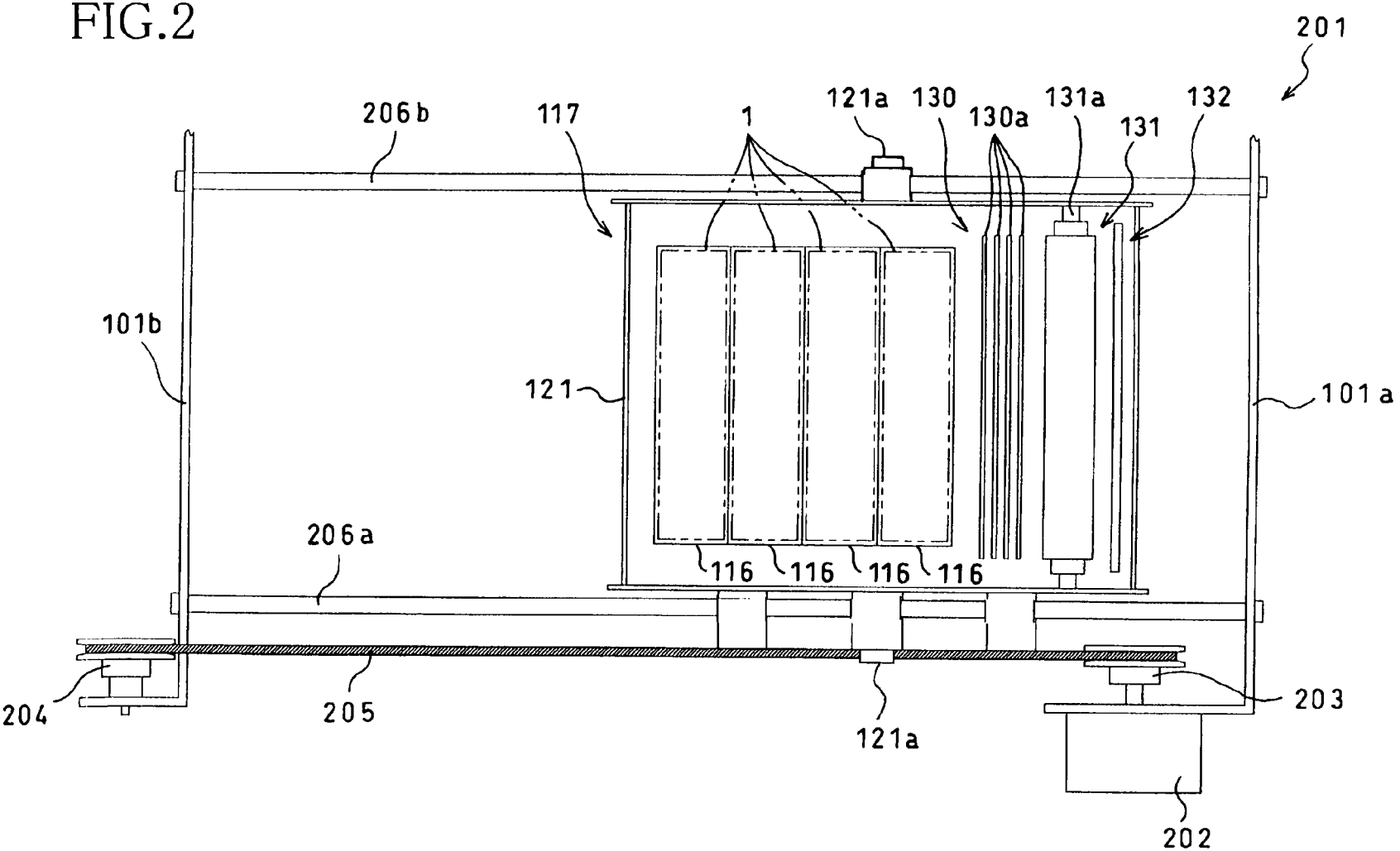
FIG. 2 is a top view showing a maintenance unit and a drive mechanism of the inkjet printer.

With reference to FIG. 2, a drive mechanism 201 that horizontally moves the maintenance unit 117 will be described below. In FIG. 2, outlines of the print heads 1 are indicated by double dashed chain lines.

As shown in FIG. 2, the drive mechanism 201 for the maintenance unit 117 includes a motor 202, a motor pulley 203, an idle pulley 204, a timing belt 205, and guide shafts 206*a*, 206*b*. The motor 202 is attached, for example, by a screw, to a main frame 101*a* provided on the right side in FIG. 2. The motor pulley 203 is connected to the motor 202, and rotates as the motor 202 is driven. The idle pulley 204 is rotatably supported by a main frame 101*b* provided on the left side in FIG. 2. The timing belt 205 is looped around the motor pulley 203 and the idle pulley 204, which are used in a pair. The timing belt 205 is connected to one end (lower end in FIG. 2) of a shaft 121*a* protruding from each side of the frame 121 of the maintenance unit 117 in parallel to the sheet feeding direction. The guide shafts 206*a*, 206*b* are disposed parallel to the timing belt 205 between the main frames 101*a*, 101*b* disposed on the right and left sides in FIG. 2. The guide shafts 206*a*, 206*b* are fixed by, for example, screws, to the main frames 101*a*, 101*b*. The guide shafts 206*a*, 206*b* support the maintenance unit 117 on each side parallel to the sheet feeding direction, with the aid of the shaft 121*a*.

As the motor 202 is driven by a signal from a controller 60 (described below), the timing belt 205 moves or runs in accordance with the rotation of the motor 202 in the forward or reverse direction. The maintenance unit 117, connected to the timing belt 205 through the shaft 121*a*, is moved rightward or leftward in FIG. 2 toward the purge or standby position, in accordance with the movement of the timing belt 205.

Figure 3:
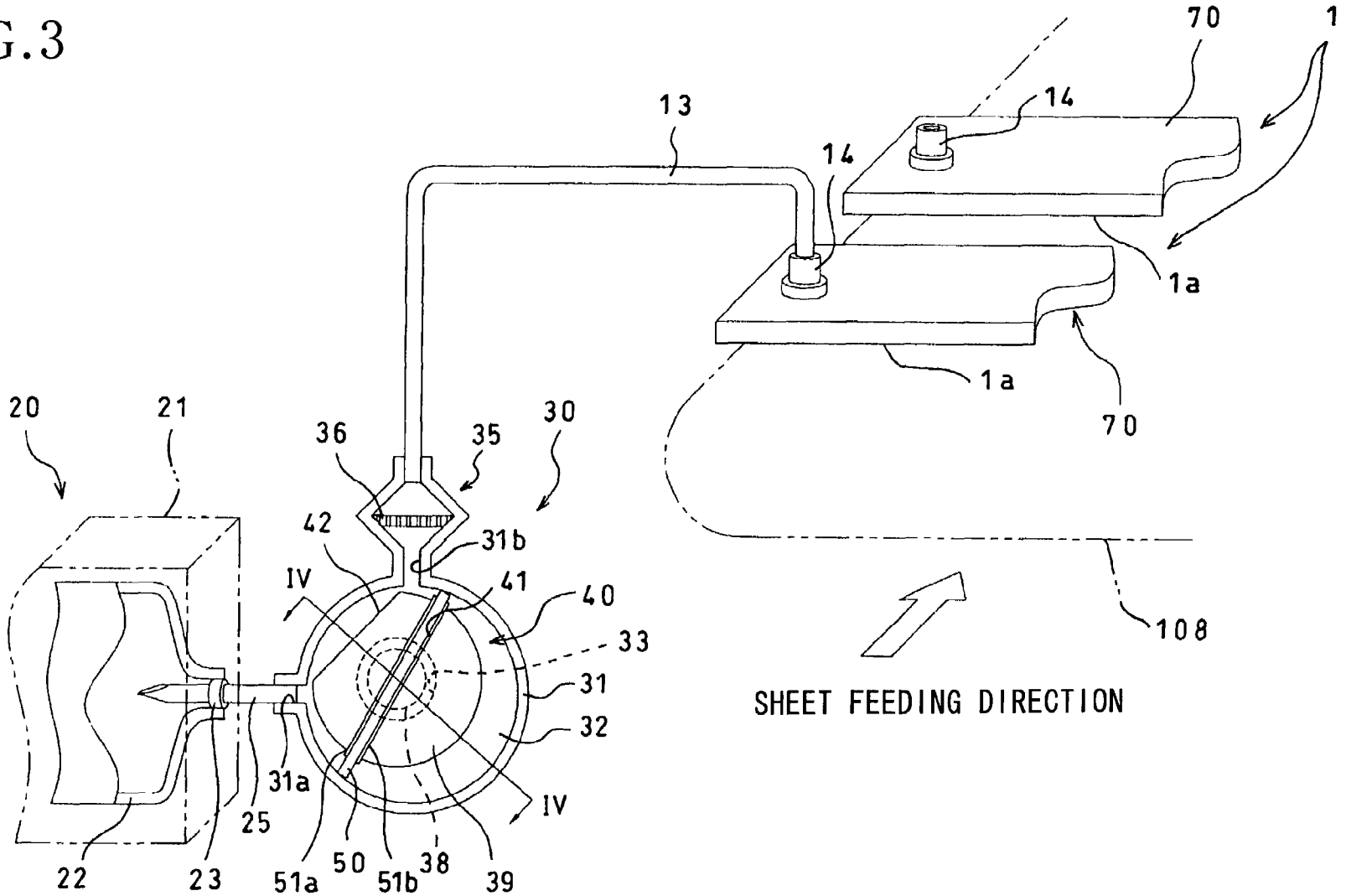
FIG. 3 is a schematic showing an ink supply passage of the inkjet printer shown in FIG. 1.

A structure for supplying ink to the print heads 1 in the inkjet printer 101 will be described with reference to FIGS. 3 and 17A to 17D. To supply different color inks to the respective print heads 1, ink cartridges (ink tank) 20 are provided in appropriate positions within the printer 101, as shown in FIG. 3. The print head 1 and the ink cartridge 20, which are positioned away from each other, are connected via a pump 30 and a flexible tube 13 connected to the pump 30. Thus, an ink supply passage from the ink cartridge 20 to the print head 1 is formed. In FIG. 3, one ink cartridge 20, one pump 30 and one tube 13 are illustrated. However, four ink cartridges 20, four pumps 30, and four tubes 13 are provided corresponding to the number of the print heads 1.

As shown in FIG. 3, the ink cartridge 20 includes an ink bag 22 in a synthetic resin case 21. The ink bag 22 contains degassed ink. The ink bag 22 has a resin spout that seals an opening of the bag 22. The spout is provided with a cap 23 made from silicone or butyl rubber. The ink bag 22 is constructed from a pouch film formed by sealing a plurality of flexible films by heat. The pouch film is structured in multi-layers, such as a polyethylene layer on an innermost side, a polyester layer as a base placed on the polyethylene layer, a vapor-deposited aluminum or silica layer as a gas barrier layer placed on the polyester layer, and a nylon layer for improving the strength of the film, laminated in this order.

A hollow needle 25 passes through the cap 23. When ink in the ink cartridge 20 runs out, the hollow needle 25 is removed from the cap 23, and the ink cartridge 20 is replaced with a new one.

Figure 17A:
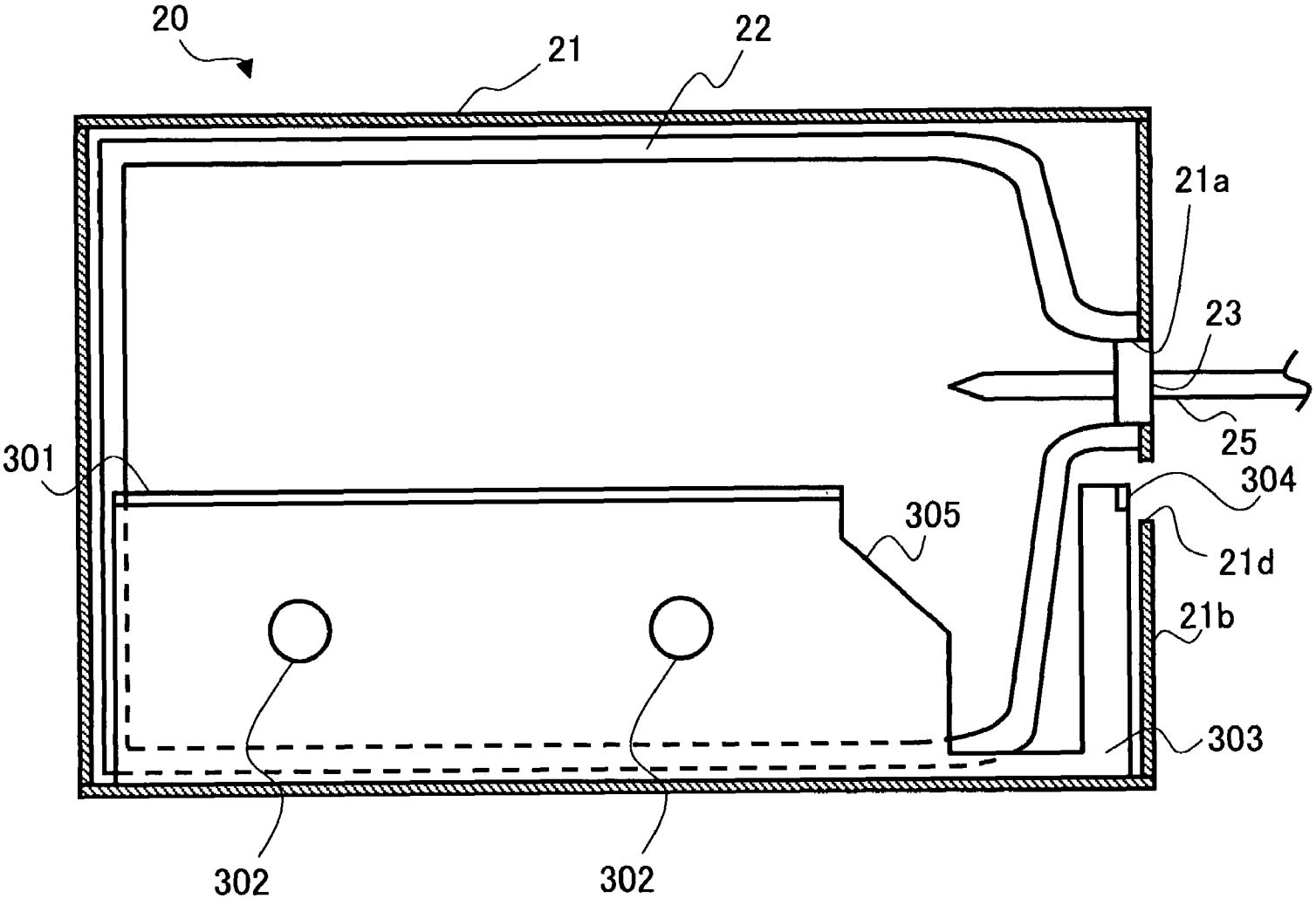
FIG. 17A is a sectional side view of an ink cartridge for use with the ink-jet printer.
Figure 17C:
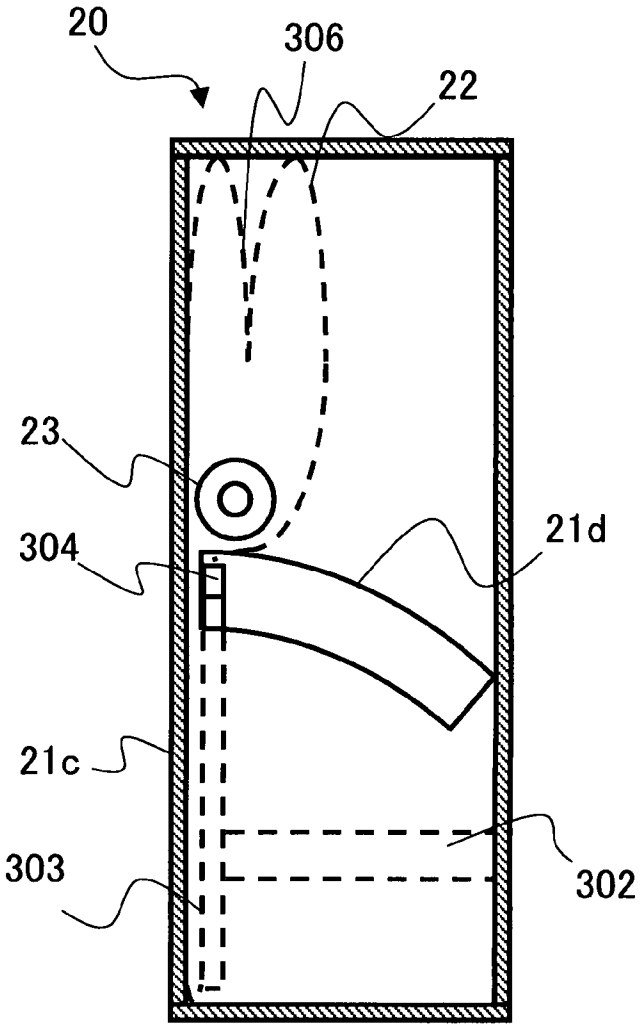
FIG. 17C is a front view of the ink cartridge in which ink in the ink bag is used and a platy member completely presses the ink bag.
Figure 17B:
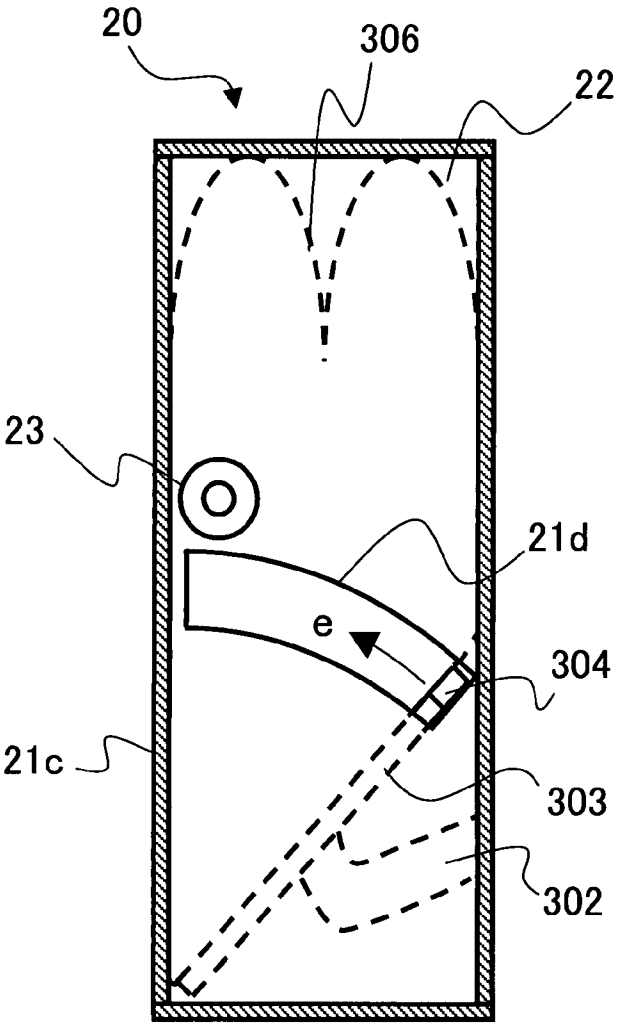
FIG. 17B is a front view of the ink cartridge in which ink in an ink bag of the ink cartridge is unused.

As shown in FIGS. 17A-17C, the ink cartridge 20 is provided inside the case 21 with a platy member 301 that contacts the ink bag 22, and a coil spring 302 that urges the platy member 301 toward the ink bag 22.

A lower end of the platy member 301 in FIG. 17A is connected to the bottom of the case 21 so as to move in the direction that the platy member 301 presses the ink bag 22 (in the direction of arrow "e" in FIG. 17B). A reverse side of the platy member 301 (opposite to the side that contacts the ink bag 22) is connected to one end of the coil spring 302 whose the other end is connected to a side wall of the case 21. As shown in FIG. 17B, when ink in the ink cartridge 20 is not used, the coil spring 302 is disposed in the ink cartridge 20 in a buckling or bending state. With the force of the coil spring 302 that tends to restore its shape from the buckling or bending state, the coil spring 302 urges the platy member 301 to the left as shown in FIGS. 17B and 17C.

The platy member 301 has a substantially L-shaped portion 303 that is disposed at a position near a surface 21*b* of the case 21. A reflective portion 304 is formed on an upper end of the L-shaped portion 303. The L-shaped portion 303 is formed at the same time as a cut portion 305 is formed on a raw material of the platy member 301, which is a substantially rectangular plate. Thus, the L-shaped portion 303 is formed on the same plane as a plane that contacts the ink bag 22.

The case 21 is formed with an ink discharge port 21*a* for discharging ink in the ink bag 22 to the outside. Disposed at the ink discharge port 21*a* is the cap 23 through which ink in the ink bag 22 is discharged.

As shown in FIG. 17B, a fold 306 is formed on an upper portion of the ink bag 22. The fold 306 is formed from a substantially upper central portion of the ink bag 22, inwardly toward the center of the ink bag 22. When the ink bag 22 is filled with ink, two crests are formed on the upper side of the ink bag 22 in FIG. 17B.

As shown in FIG. 17B, when ink in the ink bag 22 is not used, the platy member 301 is obliquely disposed and presses the ink bag 22 by an urging force of the coil spring 302. As an image is formed on the sheet with the print head 1, an amount of ink in the ink bag 22 is gradually reduced, so that the platy member 301 pivots about a lower end thereof in the direction to press the ink bag 22. When ink in the ink bag 22 is further used, the coil spring 302 expands in the horizontal direction due to its restoring force, as shown in FIG. 17C, so that the platy member 301 is vertically disposed in parallel with a side surface 21*c* of the case 21. At this time, the platy member 301 is pressed completely toward the side surface 21*c*, with a lower portion of the ink bag 22 sandwiched between the platy member 301 and the side surface 21*c*.

The reflective portion 304 is also pivotally moved in accordance with the reduction of ink in the ink bag 22. A detection window 21*d* that extends in the moving direction of the reflective portion 304 is formed on the side surface 21*b* of the case 21. The reflective portion 304 is always exposed from the case 21 through the detection window 21*d*, from when the ink in a new ink bag 22 is not used through when the platy member 301 completely presses the lower portion of the ink bag 22 toward the side wall 21*c*.

Figure 17D:
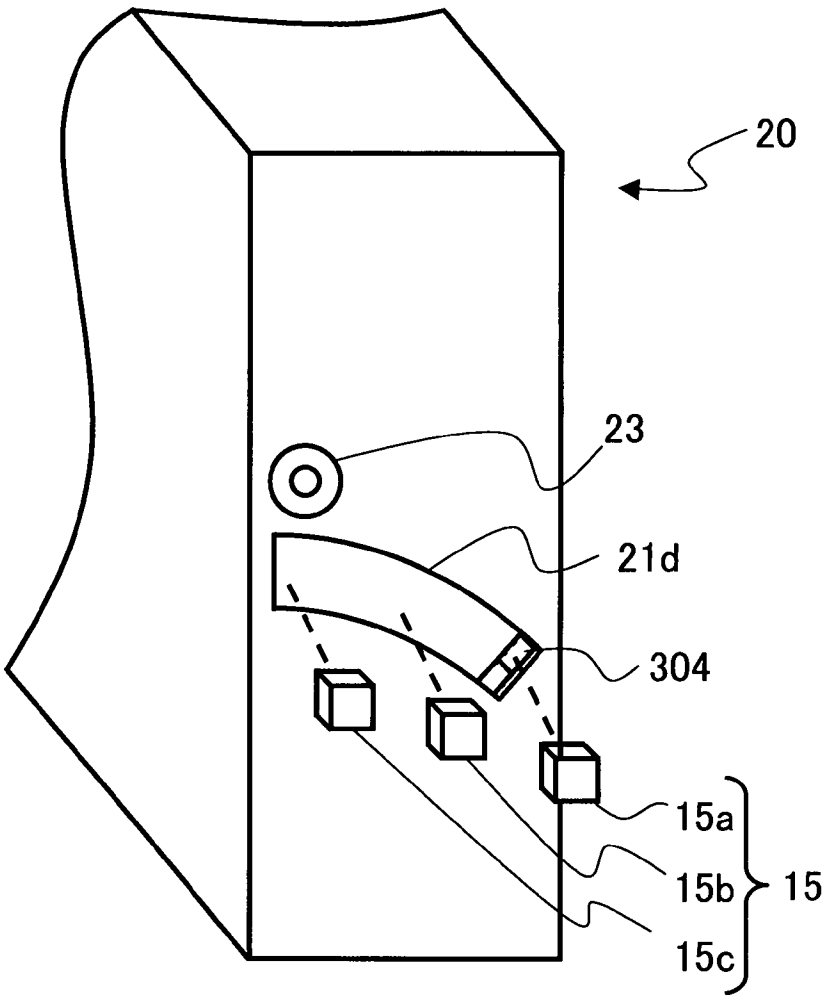
FIG. 17D is a schematic showing the ink cartridge and a residual ink amount detector.

As shown in FIG. 17D, disposed in the inkjet printer 101 in confrontation with the detection window 21*d* is the residual ink amount detector 15 including three reflective photo-sensors 15*a*, 15*b*, 15*c* that are disposed along the moving direction of the reflective portion 304. Each photo-sensor 15*a*-15*c* horizontally emits light toward the detection window 21*d*, and senses the reflected light from the reflective portion 304. Thus, the residual ink amount detector 15 detects the positions of the reflective portion 304. More specifically, the photo-sensor 15*a* detects the position of the reflective portion 304 when ink in the ink bag 22 is not used and the residual ink amount in the ink bag 22 is at a maximum. The photo-sensor 15*b* detects the position of the reflective portion 304 when the residual ink amount in the ink bag 22 is about half of the maximum residual ink amount. The photo-sensor 15*c* detects the position of the reflective portion 304 when ink in the ink bag 22 is almost used up. More than three reflective photo-sensors may be provided to detect the positions of the reflective portion 304 more precisely.

As shown in FIG. 3, each head body 70 of the print heads 1 is provided with a tubular member 14 on a surface opposite to the nozzle surface 1*a* at one end in a longitudinal direction of the print head 1. The tubular member 14 is connected to an end of the tube 13 whose the other end is connected to the pump 30. Thus, the ink supply passage is formed to lead ink in the ink cartridge 20 to the ink passage inside the head body 70 and eject ink from the ejection nozzles. The tube 13 has a tubular shape and sufficient flexibility because it is made from an elastomer.

Figure 18:
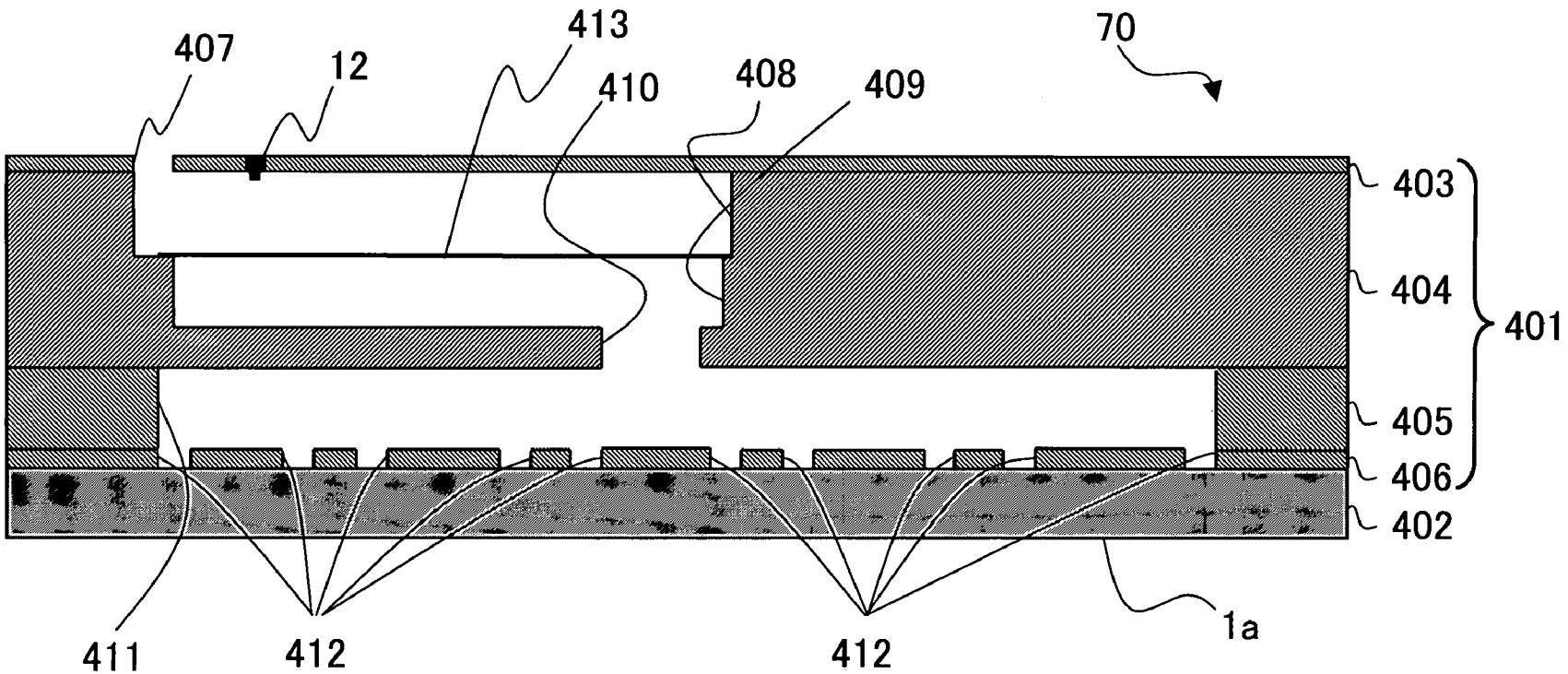
FIG. 18 is a sectional side view of the print head body.

With reference to FIG. 18, the head body 70 will be described in detail below. The top and bottom dimensions in FIG. 18 are expanded for illustrative purposes. The head body 70 includes the reservoir unit 401 and the passage unit 402 that communicate with each other. Formed in the passage unit 402 is an ink passage including pressure chambers that communicate with the ejection nozzles formed on the nozzle surface 1*a*. In FIG. 18, detailed illustration of the internal structure of the passage unit 402 is omitted. The actuator (not shown) that applies pressure to ink in the pressure chambers is affixed to the passage unit 402 between the reservoir unit 401 and the passage unit 402.

As shown in FIG. 18, the reservoir unit 401 has a laminated structure in which an upper plate 403, a filter plate 404, a reservoir plate 405, and an under plate 406 are laminated. Each of the plates 403 through 406 has a substantially rectangular shape extending along the longitudinal direction of the print head 1.

The upper plate 403 has an opening 407. The filter plate 404 has openings 408, 409, 410. The reservoir plate 405 has an opening 411. The under plate 406 has openings 412. Each opening 407-412 is in communication with each other. The opening 407 is connected to the tubular member 14, as shown in FIG. 3. A filter 413 is disposed between the openings 408, 409. The openings 412 are in communication with the passage unit 402. Ink introduced from the opening 407 through the tubular member 14 fills the openings 408 through 411 and reaches the ink passages in the passage unit 402 through the openings 412.

The upper plate 403 is provided with a pressure sensor 12 that detects ink pressure in the head body 70. A detecting portion of the pressure sensor 12 is directed toward the opening 408.

A structure of the pump 30 will be described in detail below with reference FIGS. 3 and 4. The pump 30 includes a cylindrical-shaped housing 31 with end surfaces in an axial direction thereof, so that a hollow 32 is defined in the housing 31. An opening 33, where a rotary shaft 38 of a rotor 40 passes through, is formed on one end surface of the housing 31. A suction inlet 31*a* through which ink is sucked from the ink cartridge 20 into the hollow 32 of the pump 30 is formed on a peripheral surface of the housing 31 at a position facing the cap 23 of the ink cartridge 20. The hollow needle 25, which is made of metal and has a cylindrical shape, is directly coupled to the suction inlet 31*a*. An end of the hollow needle 25, which faces toward the ink cartridge 20, is sharp because it is cut at a bevel. As shown in FIG. 3, the hollow needle 25 connected to the suction inlet 31*a* passes through the cap 23 of the ink cartridge 20 horizontally, thereby forming the ink passage between the ink cartridge 20 and the pump 30. Ink in the ink bag 22 is taken, via the hollow needle 25, into the hollow 32 of the pump 30 from the suction inlet 31*a*.

A discharge outlet 31*b* through which ink is ejected from the hollow 32 to the print head 1 is formed at a place rotated 90 degrees clockwise in FIG. 3 from the suction inlet 31*a*, on the peripheral surface of the housing 31 (in other words, in an upper vertical position on the peripheral surface of the housing 31). The discharge outlet 31*b* is connected to a filter storing portion 35, which is connected to the tube 13 connected to the tubular member 14 of the head body 70. Inside the filter storing portion 35, a communication hole is formed so as to vertically face a passage from the discharge outlet 31*b* to the tube 13. The communication hole forms a part of the ink passage from the ink cartridge 20 to the print head 1. The communication hole expands horizontally at a substantially middle portion thereof, where a filter 36 is disposed such that its filter face is positioned horizontally.

The filter 36 is a mesh filter and is designed to filter ink supplied from the ink cartridge 20 to the print head 1. Thus, the filter 36 catches foreign materials, such as rubber leavings caused by the insertion or removal of the hollow needle 25 into or from the cap 23, so that they can be removed from ink. As a result, there is no need to specially provide a filtering structure on the ink cartridge 20 side, and thus, the ink cartridge 20 can be simplified.

By forming the discharge outlet 31*b* on an upper vertical side of the housing 31, air bubbles trapped in the hollow 32, for example, when ink is initially introduced, can be smoothly discharged without opposing the buoyancy, thereby achieving high quality of bubble discharge from the ink. A comparatively great force combining the buoyancy of the bubbles and the liquid feeding force of the pump 30 is applied in an upper vertical direction to the bubbles trapped, for example, when ink is introduced in the empty hollow 32 of the pump 30 (when ink is initially introduced). The filter 36 is horizontally disposed. Therefore, bubbles trapped in ink easily can pass through the filter 36.

Figure 4:
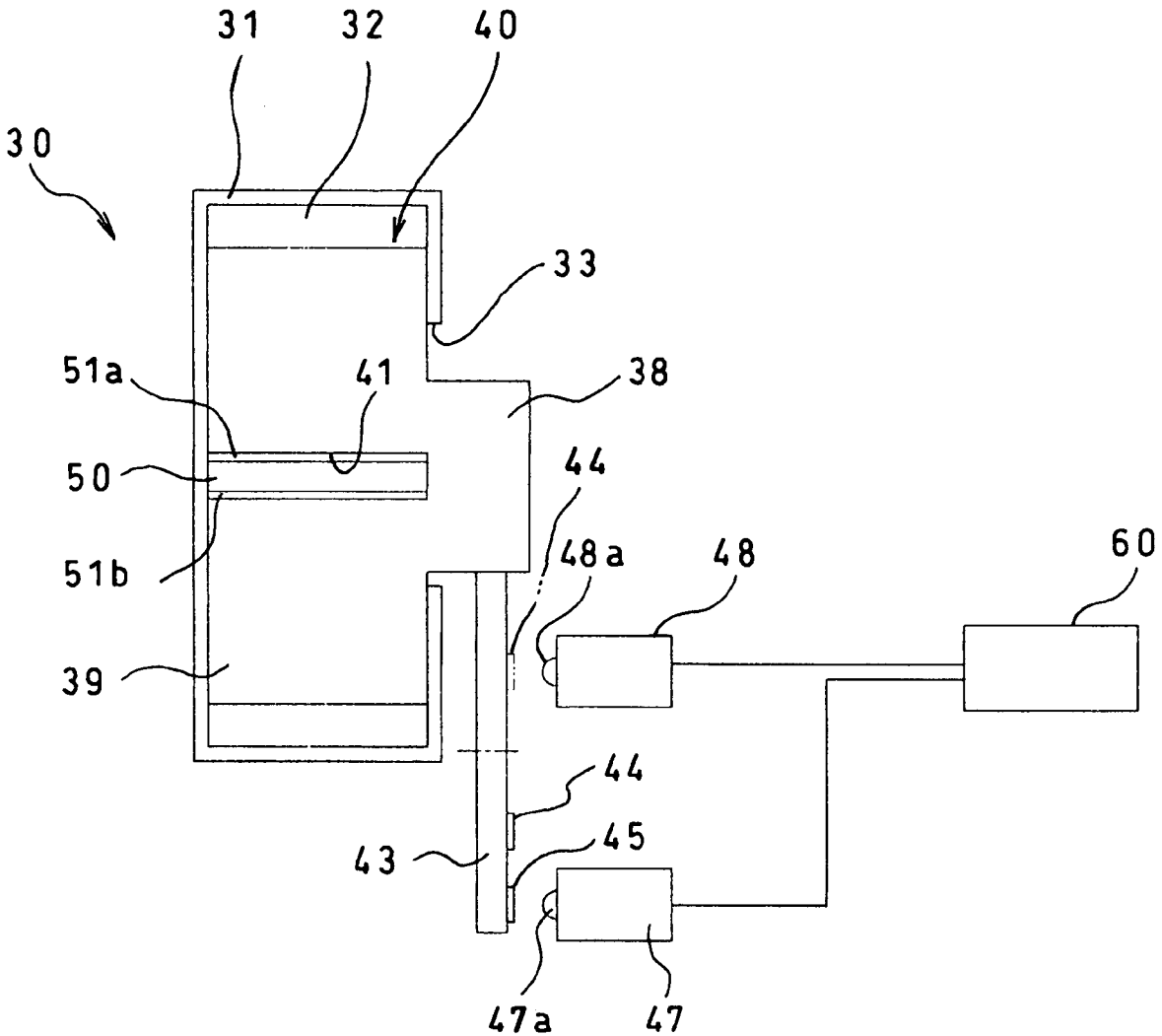
FIG. 4 is a sectional view of a pump, taken along line IV-IV of FIG. 3.
Figure 5:
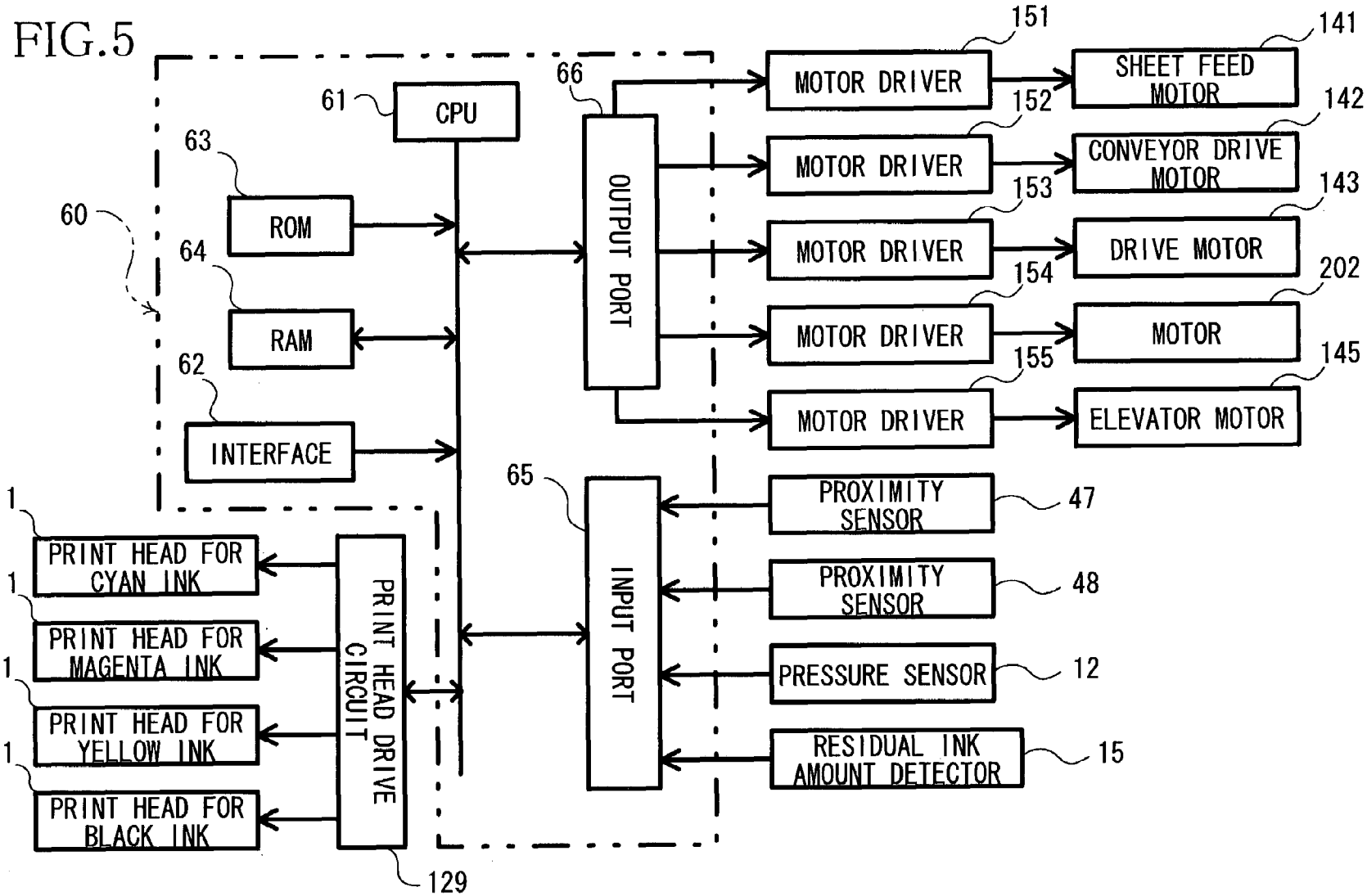
FIG. 5 is a block diagram of the inkjet printer.

As shown in FIGS. 3 and 4, the rotor 40 is rotatably disposed in the housing 31 of the pump 30 at a specified position shifted from the center of the housing 31, such that a part of the peripheral surface of the rotor 40 contacts a wall surface defining the hollow 32 (inner peripheral surface of the housing 31). The rotor 40 includes a rotating part 39 that rotates in the housing 31 and the rotary shaft 38 that transmits a rotational force to the rotating part 39. The rotating part 39 is of a cylindrical shape and has such a thickness that both end surfaces with respect to its axial direction are in contact with the end wall surfaces defining the hollow 32 (both inner end surfaces of the housing 31). The rotary shaft 38 is cylindrically shaped and is formed on one end surface of the rotating part 39, protruding in the axial direction of the rotating part 39. The rotor 40 rotates as the rotary shaft 38 is rotated by a pump drive mechanism that includes a gear 43 that constantly contacts a part of the peripheral surface of the rotary shaft 38 and a drive motor 143, as shown in FIG. 5. As the gear 43 is rotated by the drive motor 143, the rotary shaft 38 rotates as does the rotating part 39. Thus, the rotor 40 is rotated. The rotor 40 rotates with its rotating axis shifted from the central axis of the cylindrical housing 31.

Formed on the surface of the gear 43 are projections 44, 45 that extend in an axial direction of the gear 43. The projections 44, 45 are disposed in line with each other in a diametrical direction of the gear 43.

Figure 13A:
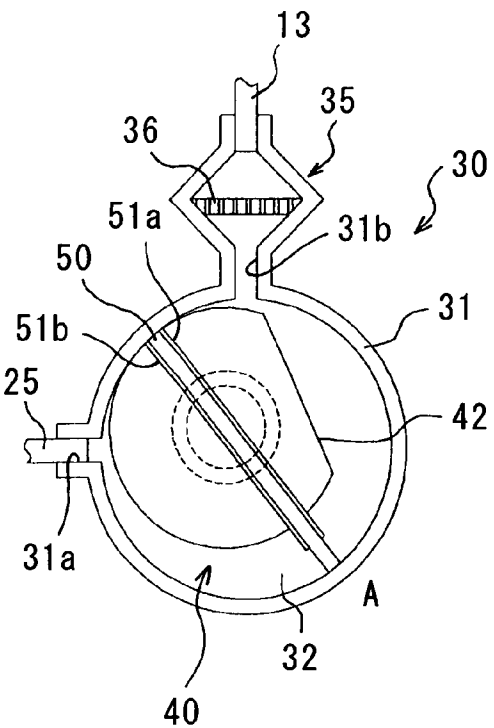
FIG. 13A is a schematic showing a state of the pump after purging.

As shown in FIG. 4, a proximity sensor 47 is disposed in confrontation with the projection 45. A proximity sensor 48 is disposed in confrontation with the projection 44 moved upward in accordance with the rotation of the gear 43, as indicated by double dashed chain lines in FIG. 4. The proximity sensors 47, 48 include detecting portions 47*a*, 48*a*, respectively. When the projections 44, 45 are brought into confrontation with the corresponding detecting portions 47*a*, 48*a*, the proximity sensors 47, 48 detect the projections 44, 45. Thus, the rotational condition of the gear 43, as well as the rotational condition of the rotor 40 rotated by the gear 43, are determined. The proximity sensor 47 detects a print position of a partition member 50 when printing is performed on the sheet with the print heads 1. With the partition member 50 placed in the print position, as shown in FIG. 3, a cut portion 42 of the rotor 40 is located in a chamber of the hollow 32 partitioned by the partition member 50, the chamber communicating with both the suction inlet 31*a* and the discharge outlet 31*b*. The proximity sensor 48 detects a stop position of the partition member 50, as shown in FIG. 13A, located at the end of the purging, which is performed with the rotor 40 of the pump 30 being rotated. With the proximity sensors 47, 48, the position of the partition member 50 can be precisely detected.

A slot 41 is formed in the rotor 40 in a diametrical direction of the rotor 40. The slot 41 is formed in such a shape as to have a very small clearance in which two sliding members 51*a*, 51*b* and the partition member 50 are disposed to overlay each other and move along the inner surface of the slot 41.

The partition member 50 made from an ethylene-propylene-diene-terpolymer (EPDM)-base synthetic rubber so as to be flexible, and the two sliding members 51*a*, 51*b* disposed so as to sandwich the partition member 50 therebetween, are disposed in the slot 41 of the rotor 40, so as to pass through the center of the rotor 40. The partition member 50 and the sliding members 51*a*, 51*b* are disposed such that both of their ends with respect to their longitudinal direction extend from the peripheral surface of the rotor 40. The partition member 50 is an elastic member, so that it can extend and contract in its longitudinal direction to reliably contact the wall surface of the hollow 32 when the rotor 40 is rotating. The sliding members 51*a*, 51*b* are made from polyoxymethylene (POM) resin.

The partition member 50 has a rectangular, flat board shape, and a length such that both end surfaces of the partition member 50 with respect to its longitudinal direction are in contact with the inner surface of the housing 31 (wall surface defining the hollow 32 in the housing 31). The partition member 50 has a thickness greater than that of either sliding member 51*a*, 51*b*. With the thus structured the partition member 50, the hollow 32 in the housing 31 is always divided into two chambers.

The two sliding members 51*a*, 51*b* are similar to the partition member 50 in shape, except that the two sliding members 51*a*, 51*b* are shorter and thinner than the partition member 50. As the sliding members 51*a*, 51*b* are formed of resin, the sliding friction coefficient of the sliding members 51*a*, 51*b* to the slot 41 is smaller than the sliding friction coefficient of the partition member 50 to the slot 41. The partition member 50, which is sandwiched between the sliding members 51*a*, 51*b* in the slot 41, is slidable relative to the rotor 40 and able to move smoothly, together with the sliding members 51*a*, 51*b*, on the inner surface of the slot 41 in a direction across the rotor 40 when the rotor 40 is rotating.

The length of the sliding members 51*a*, 51*b* are shorter than that of the partition member 50. Therefore, chances of contact between both end surfaces of the sliding members 51*a*, 51*b* and the inner surface of the housing 31 when the rotor 40 is rotated by the drive motor 143 (in FIG. 5), is relatively reduced. In addition, the sliding members 51*a*, 51*b* can prevent the partition member 50 from becoming excessively curved at both ends by friction between the ends of the partition member 50 and the inner surface of the housing 31. Accordingly, the ends of the partition member 50 are prevented from getting caught between the peripheral surface of the rotor 40 and the inner surface of the housing 31. Thus, an excessive rotational torque is not generated during rotation of the rotor 40.

As shown in FIG 3, the rotor 40 has the cut portion 42, which is a flat and level surface, formed on a part of the peripheral surface of the rotor 40, so as not to overlap the slot 41. When the cut portion 42 is located in a chamber of the hollow 32 partitioned by the partition member 50, the chamber communicating with both the suction inlet 31*a* and the discharge outlet 31*b*, the suction inlet 31*a* and the discharge outlet 31*b* are in communication with each other. Thus, an ink passage is formed in the pump 30 and printing can be performed on a recording medium, with the associated print heads 1.

The rotor 40 is also disposed at a position such that the peripheral surface of the rotor 40, where the cut portion 42 is not formed, can contact an upper left portion of the inner peripheral surface of the housing 31, as shown in FIG. 13A. As the rotor 40 is rotated, a flow resistance in the ink passage from the suction inlet 31*a* to the discharge outlet 31*b* can be increased. Thus, the flow resistance in the passage can be changed.

A control system of the inkjet printer 101 will be described with reference to FIG. 5. A controller 60 in the ink jet printer 101 includes a CPU (central processing unit) 61, an interface 62, a ROM (read only memory) 63, a RAM (random access memory) 64, an input port 65, and an output port 66. Upon the input of a print instruction signal through the interface 62, the CPU 61 of the controller 60 in the ink jet printer 101 operates in accordance with control programs stored in the ROM 63. Under the control of the CPU 61, printing operations, such as sheet supplying, feeding, and discharging, as well as ink ejection, are performed.

The CPU 61 performs various processing using the RAM 64, as required. The CPU 61 receives print data from an external device, such as a personal computer, through the interface 62. The CPU 61 generates print image data, using image data stored in the ROM 63, and stores the generated print image data in the RAM 64.

The CPU 61 drives, via a motor driver 151, a sheet feed motor 141, which is connected to the feed rollers 105*a*, 105*b* for supplying the sheets sets in the sheet supply unit 111, to the conveyor belt 108. The CPU 61 also drives, via a motor driver 152, a conveyor drive motor 142, which is connected to the belt roller 106 for applying the rotational force to the conveyor belt 108. At the start of printing with the print heads 1, the CPU 61 drives the drive motor 143, via a motor driver 153, to place the partition member 50 in the print position, as shown in FIG. 3. As the partition member 50 is placed in the print position, the proximity sensor 47 detects the projection 45 and sends a detection signal to the CPU 61, through the input port 65. The CPU 61 stops the drive motor 143 via the motor driver 153 and then drives each of four print heads 1, through a print head drive circuit 129, to perform printing based on the print image data.

When purging is performed using the pump 30, the CPU 61 drives an elevator motor 145 connected to the shaft 114, via a motor driver 155, to move the belt conveyor mechanism 103 down to a non-conveying position. Then, the CPU 61 drives a motor 202, via a motor driver 154, to move the maintenance unit 117 to the purge position. As the caps 116 of the maintenance unit 117 are placed in the purge position where the caps 116 cover the nozzle surfaces 1*a* of the relevant print heads 1, the CPU 61 drives the drive motor 143, via the motor driver 153, to rotate the rotor 40 of the pump 30. After a predetermined amount of ink is ejected from the print heads 1, during purging, to remove air bubbles in the ink, the proximity sensor 48 detects the projection 44 and sends a detection signal to the CPU 61, through the input port 65. The CPU 61 stops the drive motor 143, via the motor driver 153, to place the partition member 50 in the stop position. Thus, purging using the pump 30 ends. Thereafter, the CPU 61 drives the motor 202, via the motor driver 154, to move the maintenance unit 117 to the standby position, while driving the drive motor 143, via the motor driver 153, to rotate the rotor 40 at a speed slower than the rotating speed during purging and at a speed in which ink is not ejected from the print heads 1. Under the control of the CPU 61, purging is performed, and ink adhered to the nozzle surfaces 1*a* of the print heads 1 after purging is wiped off using the ink absorbing member 130, the wiping roller 131, and the blade 132 of the maintenance unit 117.

To wipe ink off the nozzle surfaces 1*a* by the maintenance unit 117, the CPU 61 reads data stored in the ROM 63 and the RAM 64, based on information regarding ink pressures sent from the pressure sensor 12 through the input port 65. Based on the read data, the CPU 61 determines the rotating speed of the rotor 40 to prevent meniscus formed on the ejection nozzles of the print heads 1 from being destroyed, and drives the drive motor 143, via the motor driver 153. At this time, the CPU 61 also reads data, for the determination of the rotating speed of the rotor 40, stored in the ROM 63 and the RAM 64, based on information regarding residual ink amounts in the ink cartridge 20 sent from the residual ink amount detector 15, through the input port 65. As ink in the ink cartridge 20 is reduced, head difference between ink in the cartridge 20 and ink in the print head 1 becomes larger, so that negative pressure applied to ink in the head body 70 becomes greater. Therefore, the rotating speed of the rotor 40 of the pump 30, as a control, is increased to eliminate the influences of application of the greater negative pressure to ink in the head body 70, that is, the negative pressure is reduced to within a predetermined range. More specifically, until the input of the reflective photo-sensor 15*b* is detected after the detection of the input from the reflective photo-sensor 15*a*, the CPU 61 determines that the amount of ink in the ink cartridge 20 is large and sets the rotating speed of the rotor 40, based on data stored in the ROM 63 and the RAM 64. Until the input of the reflective photo-sensor 15*c* is detected after the detection of the input from the photo-sensor 15*b*, the CPU 61 determines that the amount of ink in the ink cartridge 20 is small and sets the rotating speed of the rotor 40 faster than that set when the amount of ink in the cartridge 20 is large, based on data stored in the ROM 63 and the RAM 64. More than three reflective photo-sensors may be provided to set the rotating speeds of the rotor 40 in fine steps or more precisely.

Figure 15A:
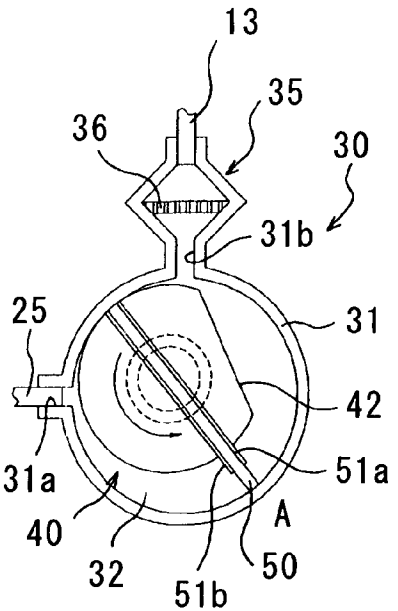
FIG. 15A is a schematic showing a state of the pump after purging.
Figure 15B:
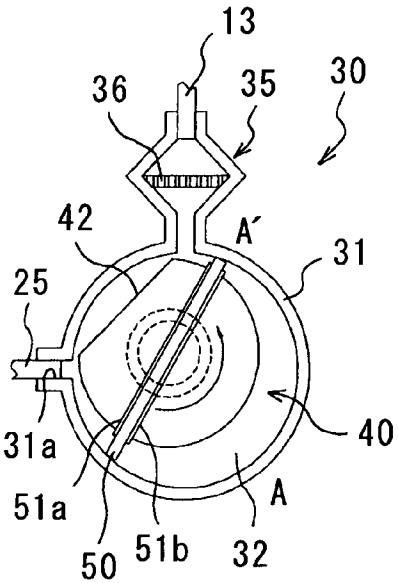
FIGS. 15B to 15D are schematics showing a rotation transition of the rotor in the pump after the purging.
Figure 15C:
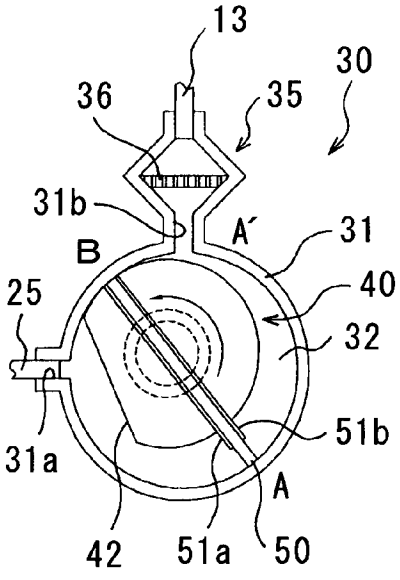
Figure 15D:
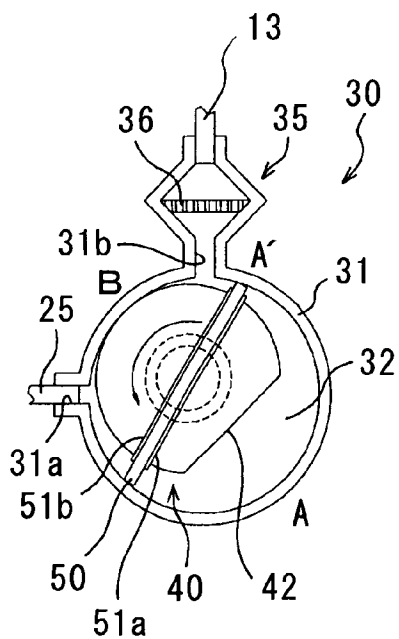

As will be described in detail below with reference to FIGS. 15A to 15D, when the partition member 50 is rotated once from position A as ink on the nozzle surfaces 1*a* is wiped by the maintenance unit 117, the rotating speed of the rotor 40 is increased by a predetermined angle (where an end of the partition member 50 moves from position A' to position B, as shown in FIGS. 15C and 15D). At this time, the CPU 61 drives the drive motor 143, via the motor driver 153, based on the detection signal output from the proximity sensor 47 that detects the projection 44, to increase the rotating speed of the rotor 40.

Ink supply to the print heads 1 during printing in the inkjet printer 101 will be described in detail below. Ink drops are ejected from the print heads 1 onto a sheet fed by the conveyor belt 108, to print a desired image on the sheet. When ink drops are ejected from the ejection nozzles of the head body 70, negative pressure is generated in the pressure chambers of the head body 70, and the print head 1 draws in ink from the ink bag 22 of the ink cartridge 20 by suction through the use of the negative pressure and capillary action of the ejection nozzles.

Thus, in the pump 30 that forms a part of the ink passage between the print head 1 and the ink cartridge 20 while the print head 1 draws in ink, the rotor 40 is stopped at a position such that the cut portion 42 of the rotor 40 is located in the chamber divided by the partition member 50 in the hollow 32, the chamber communicating with both the suction inlet 31*a* and the discharge outlet 31*b*, as shown in FIG. 3.

That is, with the cut portion 42 of the rotor 40, a clearance is formed between the rotor 40 and the inner peripheral surface of the housing 31. With the clearance, the ink passage from the print head 1 to the ink cartridge 20 is provided, so that ink is supplied to the print head 1. In addition, the flow resistance in the passage from the suction inlet 31*a* to the discharge outlet 31*b* in the pump 30 becomes low, and the ink cartridge 20 and the print head 1 are communicated with low resistance in the pump 30. Thus, during printing, ink is supplied as required from the ink cartridge 20 to the print head 1 via the pump 30, in accordance with ejection of ink from the print head 1.

A maintenance operation using the maintenance unit 117 will be described below, with reference to FIGS. 6 to 11. The maintenance operation is performed, for example, as ink is introduced to the print head 1 from the ink cartridge 20 at the first use of the printer 101, the printer 101 is used again after the lapse of a predetermined amount of time, or printing on a predetermined number of sheets is finished.

Figure 7:
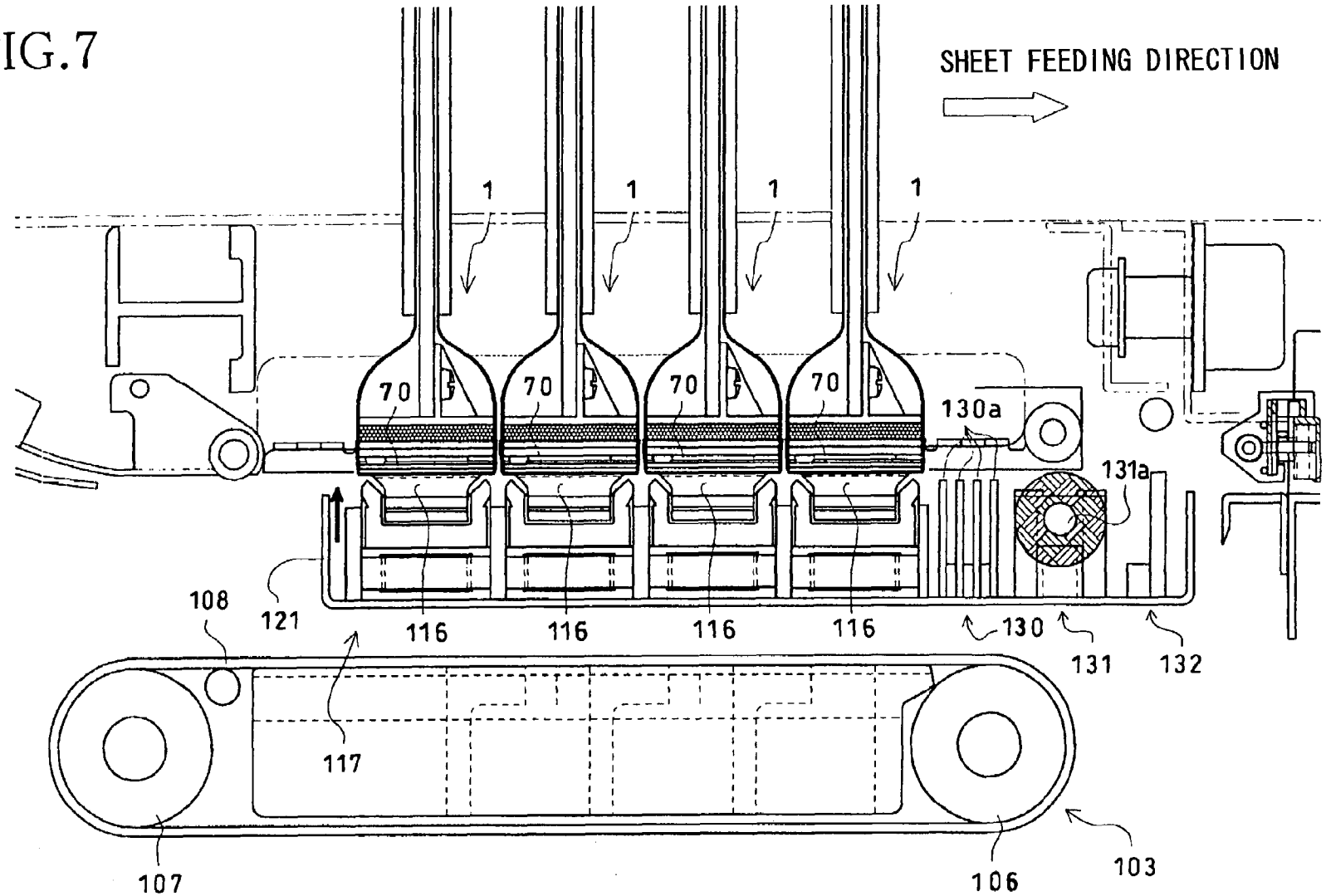
FIG. 7 is an enlarged side view of the inkjet printer, showing a state that the maintenance unit is in a purge position.

When the maintenance operation is performed for the print heads 1 using the maintenance unit 117, the belt conveyor mechanism 103 is first moved down by the elevator mechanism to the non-conveying position. As shown in FIG. 6, the maintenance unit 117, placed in the standby position, is horizontally moved by the drive mechanism 201 shown in FIG. 2 toward the print heads 1 (to the right in FIG. 6), so as to enter a space defined between the print heads 1 and the belt conveyor mechanism 103. Then, the maintenance unit 117 is placed in the purge position, as shown in FIG. 7. In the purge position, the caps 116 are raised, as shown by an arrow in FIG. 7, to a such level that the upper ends of the caps 116 are placed at the substantially same height as the nozzle surfaces 1*a*. The ink absorbing member 130, the wiping roller 131, and the blade 132 are moved, relative to the frame 121, to predetermined positions with respect to the nozzle surfaces 1*a*.

The maintenance unit 117 is temporarily stopped at the purge position where purging is performed as the pump 30 rotates. When the purge operation is performed, the caps 116 cover the relevant nozzle surfaces 1*a* of the print heads 1, as shown in FIG. 7. With the caps 116 covering the relevant nozzle surfaces 1*a*, the rotator 40 of the pump 30 is rotated, in order to eject ink from the ejection nozzles toward the caps 116. Accordingly, ink containing dust, air bubbles, viscous ink, or other contaminants is ejected from the ejection nozzles. At this time, ink is supplied from the ink cartridge 20 to the ink supply passage. The ink ejected from the ejection nozzles is discharged from the caps 116 to the waste ink reservoir, through the ink outlet.

Figure 8:
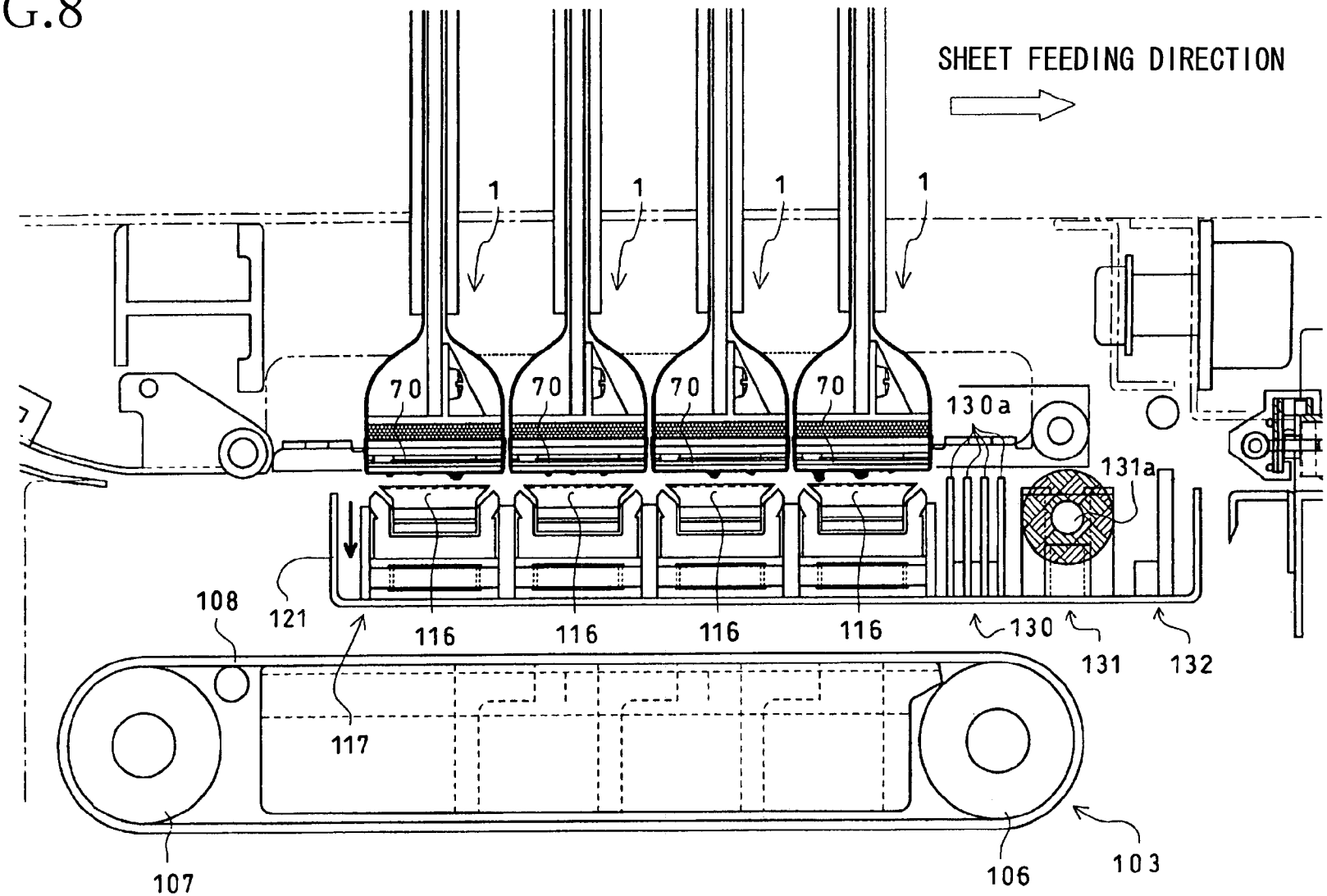
FIG. 8 is an enlarged side view of the inkjet printer, showing a state that the maintenance unit starts to move from the purge position to a standby position.

As the maintenance unit 117 starts to move leftward in FIG. 7, to the standby position, after purging using the pump 30 is finished, the caps 116 are moved down, as shown by an arrow in FIG. 8, so that the upper ends of the caps 116 are positioned slightly lower than the nozzle surfaces 1*a*. Thus, the nozzle surface 1*a* of the print head 1, previously covered by the cap 116, is exposed. The ink absorbing member 130, the wiping roller 131, and the blade 132 as moved, together with the caps 116, are not lower than the nozzle surface 1*a*. As shown in FIG. 8, ink ejected from the ejection nozzles may be left on the nozzle surface 1*a* as ink droplets.

Figure 9:
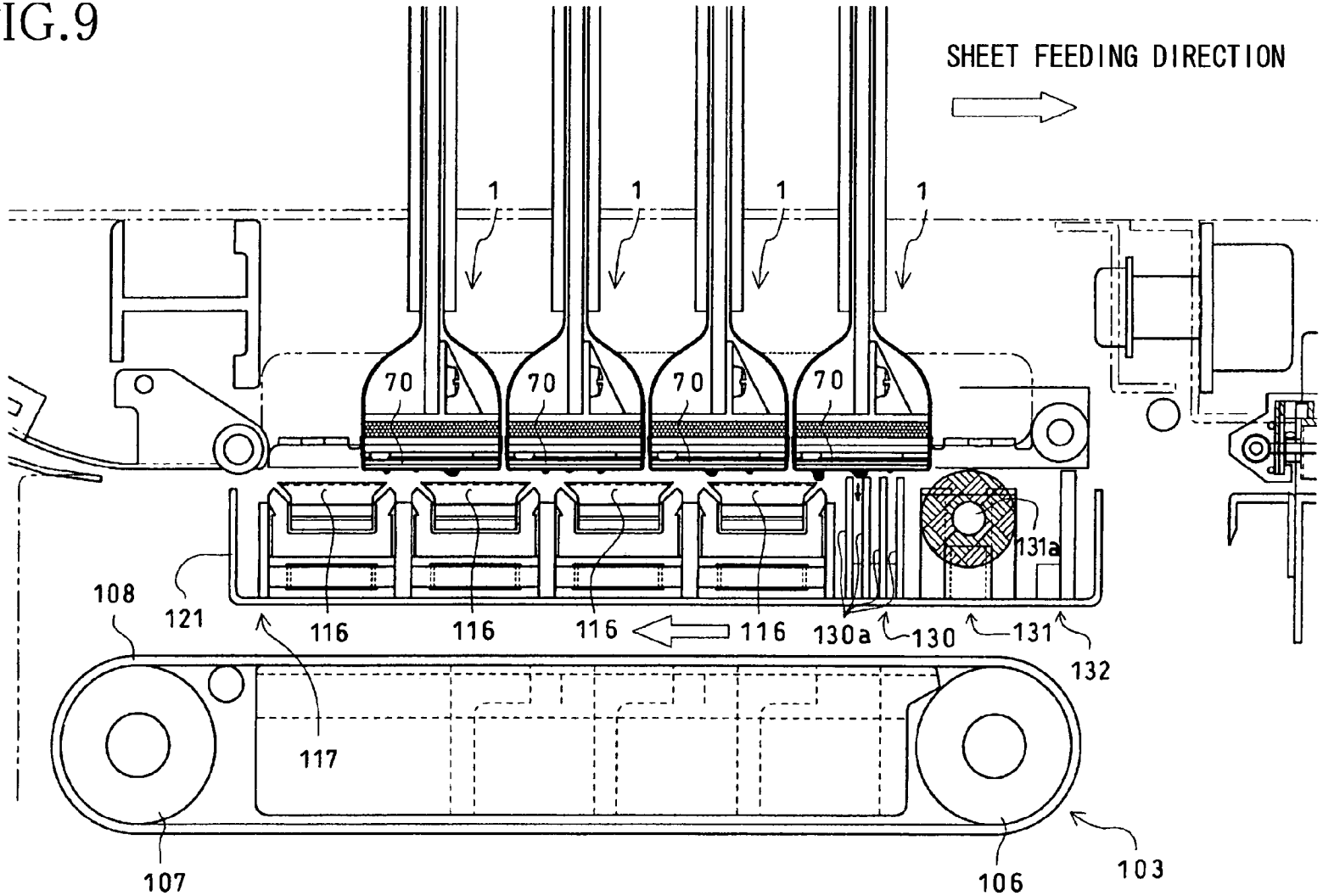
FIG. 9 is an enlarged side view of the inkjet printer, showing a state that ink on a nozzle surface is suctioned by an ink absorbing member.

As the maintenance unit 117 is moved toward the standby position, the ink absorbing member 130, the wiping roller 131, and the blade 132 are sequentially brought into confrontation with the nozzle surfaces 1*a* of the print heads 1. Ink droplets on the nozzle surfaces 1*a* are absorbed by the ink absorbing member 130 and wiped off first by the wiping roller 131, and then by the blade 132. More specifically, as shown in FIG. 9, the upper end of each plate 130*a* of the ink absorbing member 130 does not quite contact the nozzle surface 1*a*, but is disposed with a very small or fine gap between the upper end of each plate 130*a* and the nozzle surface 1*a*. A relatively large ink droplet adhered to the nozzle surface 1*a* contacts a plate 130*a* of the ink absorbing member 130, which includes a plurality of the plates 130*a*, the plates 130*a* disposed adjacent to each other and out of contact with the nozzle surface 1*a*. The ink droplet that contacts the plate 130*a* moves toward the side of the plate 130*a*, as shown by an arrow in FIG. 9, by capillar action to be drawn between the plates 130*a*.

Figure 10:
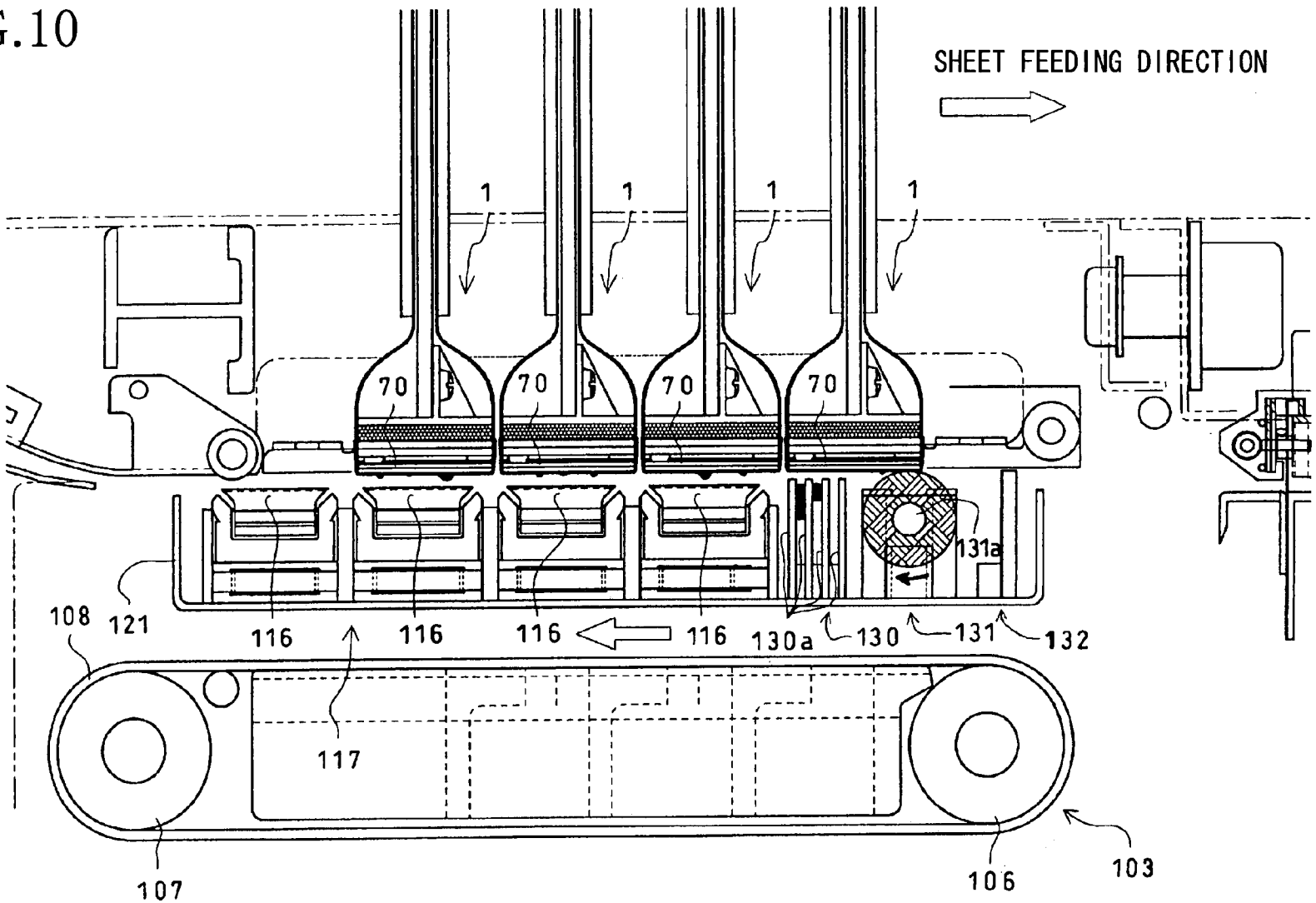
FIG 10 is an enlarged side view of the inkjet printer, showing a state that a first wiping operation by a wiping roller is performed while the maintenance unit is further moved toward the standby position from the position shown in FIG. 9.

In FIG. 10, the maintenance unit 117 is further moved toward the standby position from the position shown in FIG. 9 and a first wiping operation by the wiping roller 131 is performed. The upper surface of the wiping roller 131 is disposed substantially at the same level as the nozzle surfaces 1*a*, so that the wiping roller 131 contacts the nozzle surfaces 1*a* when brought into confrontation with the nozzle surfaces 1*a*. The wiping roller 131 is rotatably supported by the shaft 131*a*. Therefore, while contacting the nozzle surface 1*a*, the wiping roller 131 rotates clockwise, as shown by an arrow, in accordance with the movement of the maintenance unit 117. Relatively small ink droplets on the nozzle surface 1*a*, which are not removed by the ink absorbing member 130, are wiped off by the wiping roller 131. The wiping roller 131 is formed of a porous material that can absorb ink, so that ink wiped by the wiping roller 131 is absorbed into an interior of the wiping roller 131 from its surface.

Figure 11:
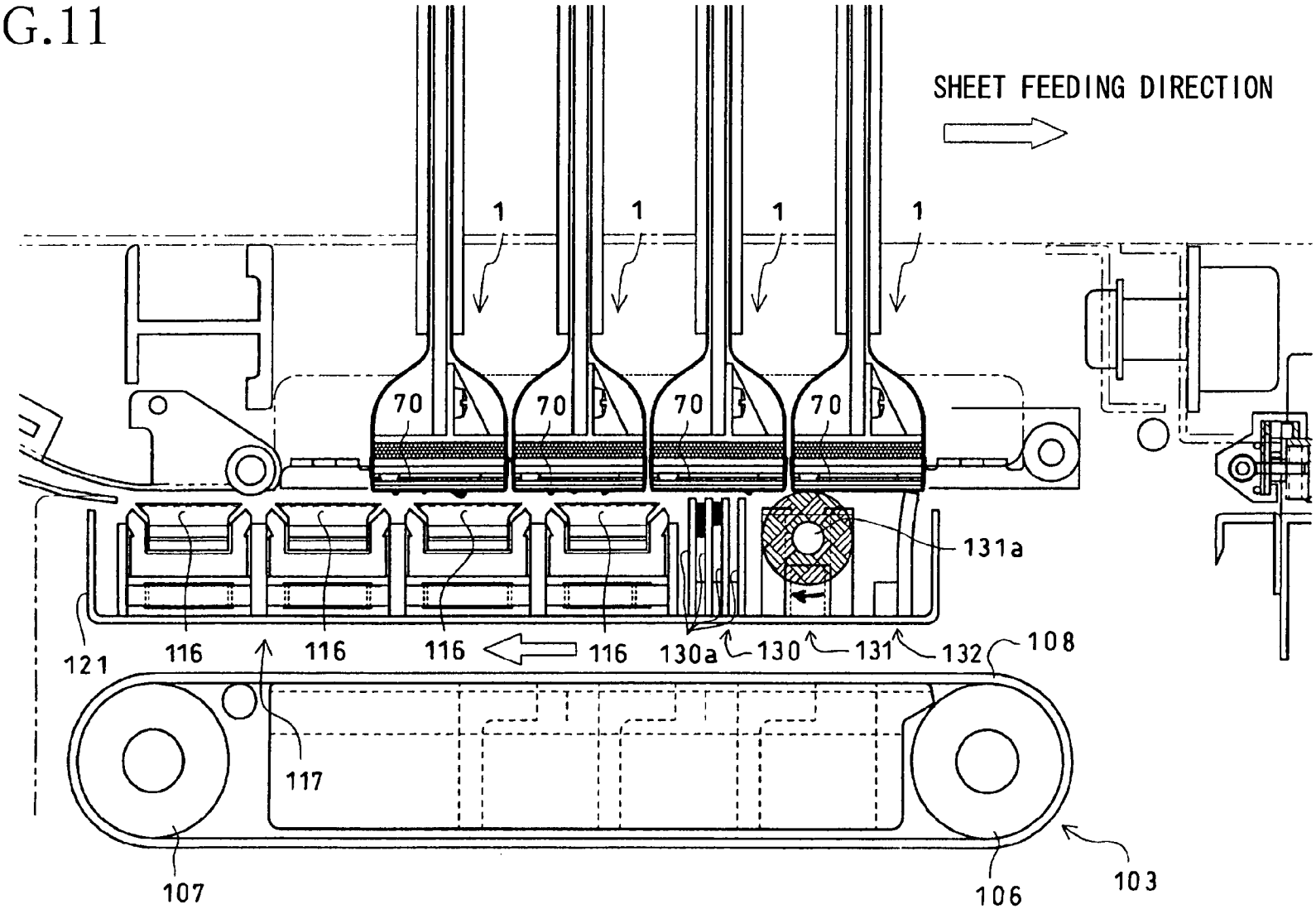
FIG. 11 is an enlarged side view of the inkjet printer, showing a state that a second wiping operation by a blade is performed while the maintenance unit is further moved toward the standby position from the position shown in FIG. 10.

In FIG. 11, the maintenance unit 117 is further moved toward the standby position from the position shown in FIG. 10 and a secondary wiping operation by the blade 132 is performed. The upper end of the blade 132 is disposed at a level slightly higher than the nozzle surfaces 1*a*, so that the blade 132 contacts the nozzle surface 1*a* while flexing when the blade 132 is brought into confrontation with the nozzle surface 1*a*. Thus, the blade 132 wipes ink off the nozzle surface 1*a*. The maintenance unit 117 according to the embodiment wipes ink off the nozzle surfaces 1*a* in one continuous operation when moved from the purge position to the standby position.

Figure 12A:
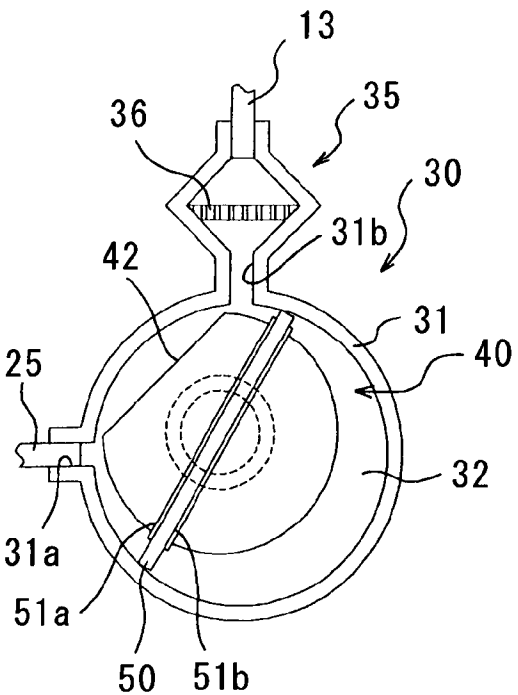
FIG. 12A is a schematic showing a state of the pump during printing.

The pump operation during purging in the inkjet printer 101 will be described below with reference to FIGS. 12A to 12C. When the purging is conducted, for example after replacement of the ink cartridge 20, the gear 43 is rotated by the drive motor 143 from a state shown in FIG. 12A, to rotate the rotor 40. The pump 30 can forcibly send ink to the print head 1 only with the rotation of the rotor 40. In other words, when the rotor 40 is rotated in a forward direction as shown by an arrow in FIG. 12B, the peripheral surface of the rotor 40, except for the cut portion 42, makes contact with the inner peripheral surface of the housing 31 and flow resistance in the ink passage from the suction inlet 31*a* to the discharge outlet 31*b* becomes very high. In the state shown in FIG. 12B, the hollow 32 is divided into three chambers: a chamber that is communicating with the suction inlet 31*a*, a chamber communicating with the discharge outlet 31*b*, and a chamber not communicating with the suction inlet 31*a* or the discharge outlet 31*b*. Then, when the rotor 40 is further rotated in the direction of the arrow as shown in FIG. 12C, the chamber communicating with the suction inlet 31*a* expands, where negative pressure is generated and ink is sucked from the ink cartridge 20. On the other hand, the chamber communicating with the discharge outlet 31*b* shrinks with the rotation of the rotor 40 and ink remaining in the chamber is forcibly sent from the discharge outlet 31*b* to the print head 1. With such a structure, when ink is suctioned into the hollow interior through the ink suction inlet, and discharged through the ink discharge outlet, the ink suction and discharge may be efficiently performed.

Figure 12B:
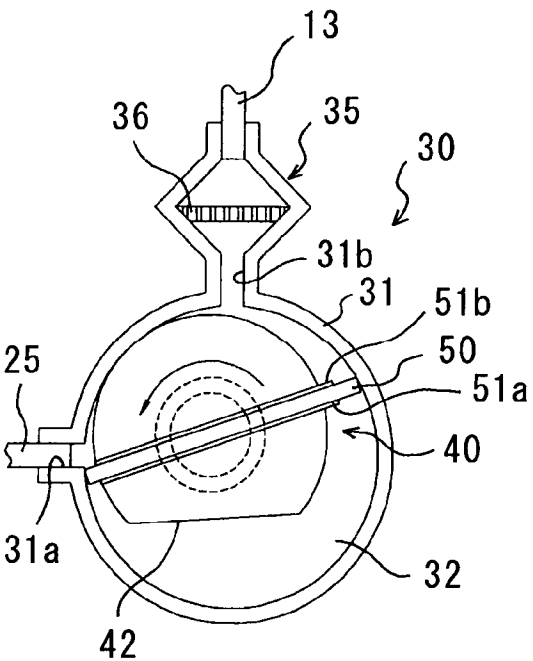
FIGS. 12B and 12C are schematics showing a rotation transition of a rotor in the pump during purging.
Figure 12C:
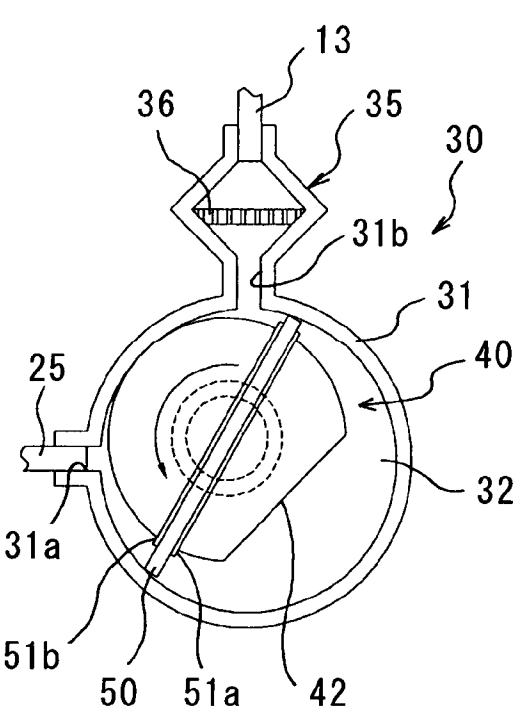

With the rotation of the rotor 40, the partition member 50 and the sliding members 51*a*, 51*b*, disposed in the slot 41 of the rotor 40, slide on the inner surface of the slot 41 as shown in FIG 12C from a state shown in FIG 12B and move toward a direction across the rotor 40. While the partition member 50 is moving, the sliding members 51*a*, 51*b* smoothly slide on the inner surface of the slot 41, so that the partition member 50 can be moved smoothly.

With the rotation of the rotor 40, the partition member 50 moves while expanding and shrinking in the longitudinal direction thereof, so that both end surfaces of the partition member 50 are in constant contact with the inner surface of the housing 31. By the movement, expansion and shrinkage of the partition member 50 with rotation of the rotor 40, negative pressure can be generated within the chamber communicating with the suction inlet 31*a*, and ink present in the chamber communicating with the discharge outlet 31*b* can be ejected from the discharge outlet 31*b*.

When the rotor 40 is rotated as the peripheral surface of the rotor 40, except for the cut portion 42, contacts the inner surface of the housing 31 with the high flow resistance in the ink passage from the suction inlet 31*a* to the discharge outlet 31*b*, ink in the ink cartridge 20 is forcibly sucked from the suction inlet 31*a* into the pump 30 and ejected from the discharge outlet 31*b*. Thus, ink can be forcibly sent to the print head 1, via the tube 13 connected to the discharge outlet 31*b*. Therefore, bubbles in the ink or those trapped in the ink from the tube 13 connected to the discharge outlet 31*b* of the pump 30 can be purged. The pump operation after purging in the inkjet printer 101 will be described below.

After purging, ink droplets may be possibly left on the nozzle surface 1*a* of the print head 1. The ink droplets are removed from the nozzle surface 1*a* by the maintenance unit 117. The partition member 50 of the pump 30 is placed in the stop position shown in FIG. 13A, until wiping of ink on the nozzle surface 1*a* is started after the purging. In the stop position, one end of the partition member 50 is placed at a contact portion where peripheral surface of the rotor 40, except for the cut portion 42, makes contact with the upper left inner surface of the housing 31, and the other end of the partition member 50 makes contact with the lower right inner surface of the housing 31. With the partition member 50 placed at the stop position, flow resistance in the ink passage from the suction inlet 31*a* to the discharge outlet 31*b* becomes very high, and the suction inlet 31*a* and the discharge outlet 31*b* do not communicate with each other. Therefore, the backflow of ink from the print head 1 can be prevented during the time until the wiping of the ink adhered to the nozzle surface 1*a* is started after the purging.

Figure 13B:
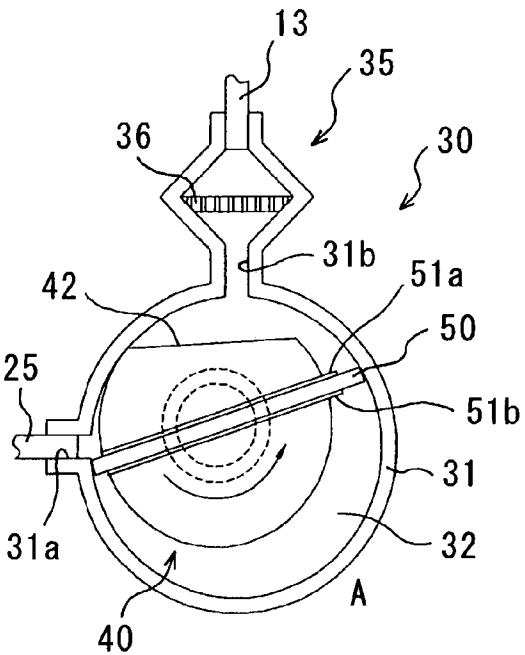
FIGS. 13B and 13C are schematics showing a rotation transition of the rotor in the pump after purging.
Figure 13C:
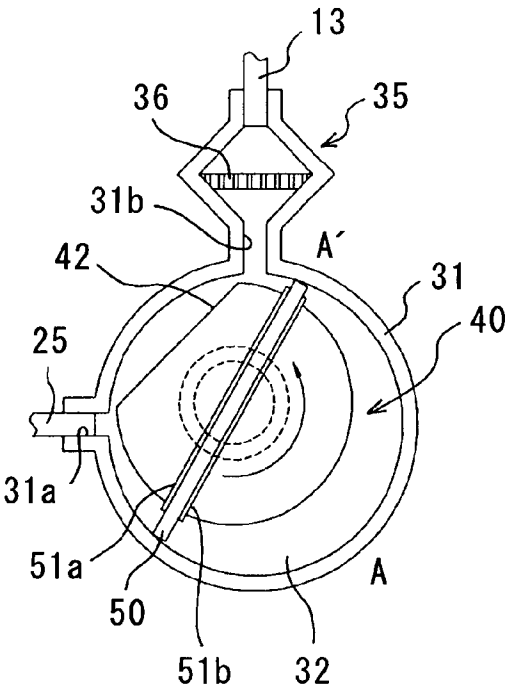

As wiping of ink adhered to the nozzle surface 1*a* with the maintenance unit 117 is started, the rotor 40 of the pump 30 starts to rotate slowly in the counterclockwise direction, as shown by arrows in FIGS. 13B and 13C. Accordingly, the other end of the partition member 50 located in position A (on the inner peripheral surface of the housing 31), as shown in FIG. 13A is moved to position A' (on the inner peripheral surface of the housing 31), as shown in FIG. 13C. The rotor 40 is driven by the drive motor 143 at such a rotating speed that moves the other end of the partition member 50 from position A to position A', during the time from the start of wiping of ink on the nozzle surfaces 1*a* with the maintenance unit 117 to the end of the wiping, so that the other end of the partition member 50 reaches position A' at the substantially same time when the wiping of ink on all of the four nozzle surfaces 1*a* is finished.

Figure 14:
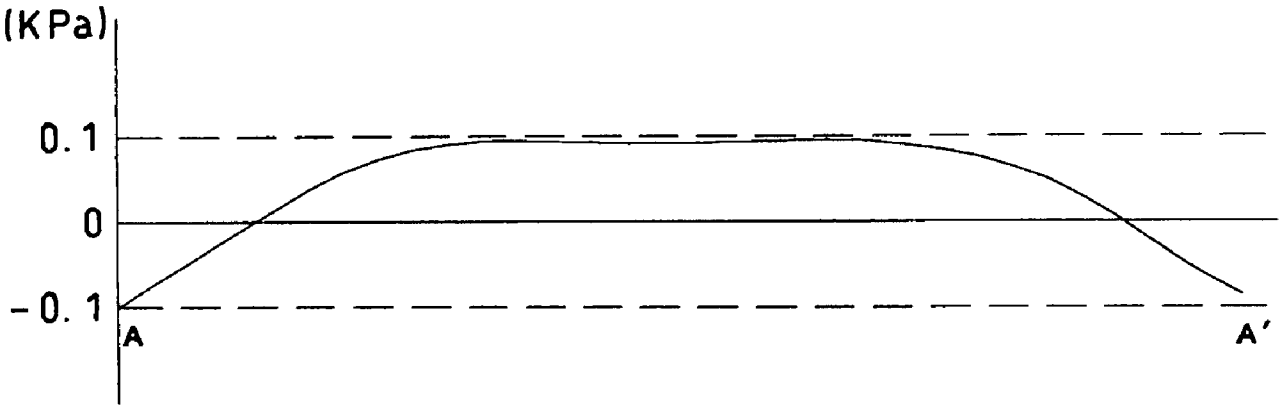
FIG. 14 is a graph showing a fluctuation of ink pressure in a print head body in accordance with the rotation of the pump when the maintenance unit wipes ink off the nozzle surface.

The pressures of ink in the print head 1, as the other end of the partition member 50 is moving from position A to position A' is shown in FIG. 14. Ink pressure when the other end of the partition member 50 is in position A is negative. As the other end of the partition member 50 starts to move from position A toward position A', the ink pressure soon turns positive. When the other end of the partition member 50 reaches position A', ink pressure again turns negative. More specifically, in FIG. 13A, the chamber divided by the partition member 50 in the hollow 32 and communicating with the discharge outlet 31*b*, gradually becomes smaller with the movement of the other end of the partition member 50 from position A to position A', so that ink pressure in the print head 1 is raised and turns from negative to positive. As the other end of the partition member 50 reaches position A' of the print position, the cut portion 42 is located in the chamber divided by the partition member 50 in the hollow 32 communicating with the suction inlet 31*a* and the discharge outlet 31*b*, as shown in FIG. 13C, so that the suction inlet 31*a* and the discharge outlet 31*b* can communicate with each other. Therefore, ink pressure in the print head 1 is lowered and turns from positive to negative. As shown in FIG. 14, the ink pressure fluctuates within the upper and lower limits of about ±0.1 KPa. Therefore, ink ejection from the print heads 1 and the backflow of ink, which adheres to the nozzle surfaces 1*a* and may contain dust, bubbles, or other contaminants, into the respective head bodies 70 is prevented during the movement of the other end of the partition member 50 from position A to position A'. When the other end of the partition member 50 reaches position A', wiping of ink adhered to the nozzle surface 1*a* with the maintenance unit 117 is finished. As such, during removing the ink adhered to an ink ejection surface of the print head, while ink adhered to the ink ejection surface is removed, backflow of the ink into the print head may be prevented or reduced and the ink pressure is kept within the predetermined range.

Figure 16:
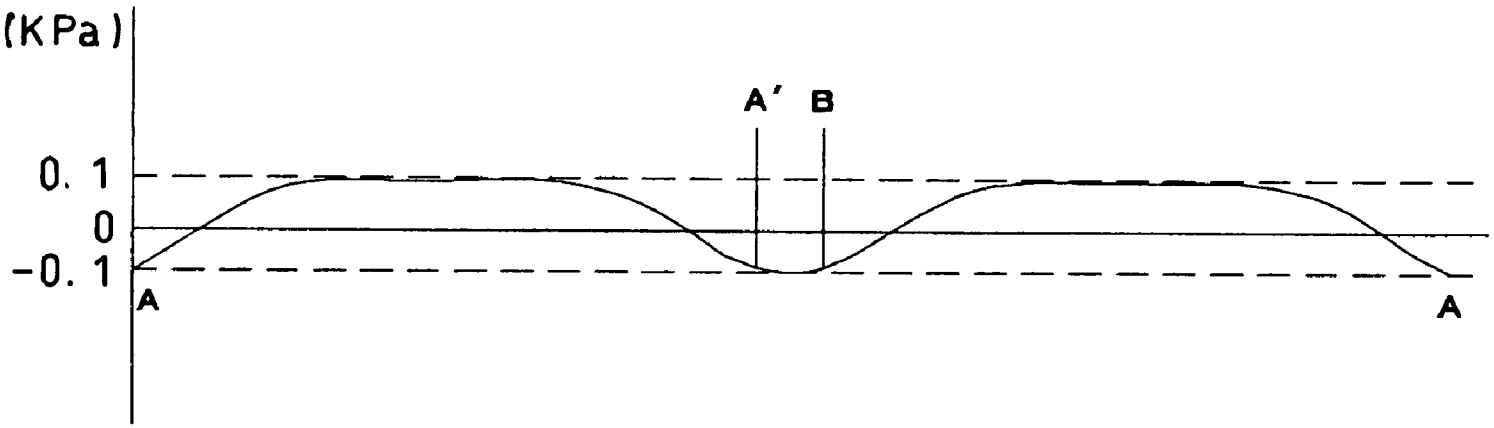
FIG. 16 is a graph showing a fluctuation of ink pressure in a print head body in accordance with the rotation of the pump when the maintenance unit wipes ink off the nozzle surface.

In the inkjet printer 101 according to the embodiment, four print heads 1 are aligned along the sheet feeding direction. The rotor 40 is rotated to move the other end of the partition member 50 from position A to position A' during the time from the start of wiping of ink on the nozzle surfaces 1*a* with the maintenance unit 117, to the end of the wiping. When the inkjet printer 101 is provided with more than four print heads 1, for example, eight print heads 1, it takes longer time to wipe ink off the nozzle surfaces 1*a* with the maintenance unit 117. The rotor 40 has to be rotated in accordance with the increase in the time of wiping ink adhered to the nozzle surfaces 1*a*. More specifically, when the maintenance unit 117 starts to wipe ink off the nozzle surfaces 1*a* of the print head 1, the rotor 40 of the pump 30 is rotated slowly in the forward direction, as shown by arrows in FIGS. 15B to 15D. The other end of the partition member 50 located in position A, as shown in FIG. 15A moves back to position A, through position A' as shown in FIG. 15B and position B shown in FIG. 15C. At this time, the rotor 40 is driven by the drive motor 143 at such a rotating speed that rotates the other end of the partition member 50 once from position A, during the time from the start of wiping of ink on the nozzle surfaces 1*a* with the maintenance unit 117 to the end of the wiping, so that the other end of the partition member 50 moves back to position A at substantially same time when the wiping of ink from all of the eight nozzle surfaces 1*a* is finished. The pressures of ink in the print head 1, while the other end of the partition member 50 is rotating once from position A, is shown in FIG. 16. Ink pressure when the other end of the partition member 50 is in position A, is negative. As the other end of the partition member 50 starts to move from position A toward position A', the ink pressure soon turns positive. Then, as the other end of the partition member 50 approaches position A', the ink pressure turns negative again. When the other end of the partition member 50 is moving from position A' to position B, the ink pressure remains negative. As the other end of the partition member 50 starts to move from position B back to position A, the ink pressure soon turns positive. As the other end of the partition member 50 returns to position A, the ink pressure again turns negative. More specifically, in FIG. 15A, the chamber divided by the partition member 50 in the hollow 32 and communicating with the discharge outlet 31*b*, gradually becomes smaller with the movement of the other end of the partition member 50 from position A to position A', and ink pressure in the print head 1 is raised and turns from negative to positive. As the other end of the partition member 50 reaches position A' of the print position, the cut portion 42 is located in the chamber divided by the partition member 50 in the hollow 32 and communicating with the suction inlet 31*a* and the discharge outlet 31*b*, as shown in FIG. 15B, so that the suction inlet 31*a* and the discharge outlet 31*b* can communicate with each other. Ink pressure in the print head 1 is lowered and turns from positive to negative. When the other end of the partition member 50 moves from position A' toward position B, the rotating speed of the rotor 40 is increased to prevent the ink pressure from being lowered below −0.1 KPa, due to the suction inlet 31*a* and the discharge outlet 31*b* being brought into communication with each other by the cut portion 42. As the other end of the partition member 50 reaches position B, the rotating speed of the rotor 40 is reduced to the previous rotating speed. As the other end of the partition member 50 passes through position B, the one end of the partition member 50 is moved from position A toward position A'. In FIG. 15C, the chamber divided by the partition member 50 in the hollow 32 and communicating with the discharge outlet 31*b*, gradually becomes smaller, and ink pressure in the print head 1 is raised and turns from negative to positive. When the other end of the partition member 50 moves toward the initial position A and the one end of the partition member 50 passes through position A', the chamber not having communicated with the suction inlet 31*a* and the discharge outlet 31*b*, as shown in FIG. 15D, communicates with the discharge outlet 31*b*. Accordingly, the ink pressure is lowered and turns negative. As the other end of the partition member 50 returns to position A, the rotor 40 stops rotating, so that fluctuations in the ink pressure are also stopped. As shown in FIG. 16, the ink pressure fluctuates within the upper and lower limits of about +0.1 KPa. Therefore, ink ejection from the print heads 1 and backflow of ink, which adheres to the nozzle surfaces 1*a* and may contains dust, bubbles, or other contaminants, into the head bodies 70 is prevented as the other end of the partition member 50 is rotating once from position A. As the other end of the partition member 50 returns to the initial position A, wiping of ink on the nozzle surface 1*a* with the maintenance unit 117 is finished.

In the inkjet printer 101 according to the embodiment, to wipe ink adhered to the nozzle surfaces 1*a* of the print heads 1 with the maintenance unit 117 after the purging, the rotor 40 of the pump 30 is rotated in such a manner that ink is not ejected from the ejection nozzles of the print heads 1 and does not flow back into the head bodies 70 (i.e. ink pressure in the head bodies 70 remains within ±0.1 KPa). Therefore, the backflow of ink is prevented, and the entry of dust, bubbles, or other contaminants in the ink, which adheres to the nozzle surfaces 1*a*, into the head bodies 70 can be prevented. A head difference exists between ink in the cartridge 20 and ink in the head body 70. Negative pressure is constantly applied to ink in the head bodies 70 in a condition where the pump 30 is not activated. By applying a predetermined pressure to ink in the head bodies 70 after the purging, or maintaining the fluctuations of ink pressure within a certain range, ink adhered to the nozzle surfaces 1*a* is not drawn into the ejection nozzles before ink is wiped off by the maintenance unit 117. Therefore, ink ejection failures can be reduced. Ink adhered to the nozzle surfaces 1*a* may be wiped off by the maintenance unit 117, with the partition member 50 kept in the stop position. In this case, flow resistance in the pump 30 becomes great, so that backflow of ink, which is adhered to the nozzle surfaces 1*a*, can be prevented.

During the wiping of ink adhered to the nozzle surfaces 1*a* with the maintenance unit 117, the rotating speed of the rotor 40, when the other end of the partition member 50 is moving from position A' toward position B, is faster than the rotating speed when the other end of the partition member 50 is moving to other positions. Therefore, the time can be minimized during which flow resistance in the passage from the suction inlet 31*a* to the discharge outlet 31*b* is reduced, due to the cut portion 42 located in the chamber divided by the partition member 50 in the hollow 32 and communicating with the suction inlet 31*a* and the discharge outlet 31*b*. Thus, fluctuations of ink pressure in the print heads 1 can be minimized. Accordingly, ink is not ejected from the print heads 1 during the wiping of ink off the nozzle surfaces 1*a*, and backflow of ink can be reliably prevented. As ink in the ink cartridge 20 is reduced, the rotating speed of the rotor 40 is increased during the wiping of ink off the nozzle surface 1*a* with the maintenance unit 117, so that reduction of ink pressure further toward the negative side, due to the head difference, can be prevented. Therefore, even when an amount of ink in the ink cartridge 20 is small, the backflow of ink can be preferably prevented.

The maintenance unit 117 of the printer 101 according to the embodiment, is movable in the direction parallel to the sheet feeding direction. However, the maintenance unit 117 may be structured to move in a direction perpendicular to the sheet feeding direction, along the longitudinal direction of the print heads 1. In this case, the maintenance unit 117 and the drive mechanism 201 may be disposed near the belt conveyor mechanism 103 on an end side of the print heads 1 in the longitudinal direction, with the blade 132, the wiping roller 131, the ink absorbing member 130, and the cap 116 aligned in this order from a side nearer to the print heads 1 along the longitudinal direction of the print heads 1. In the ink-jet printer having such a structure, the time required to wipe ink off the nozzle surfaces 1*a* by the maintenance unit 117 differs according to the length of the print heads 1. For example, if the length of the print heads 1 is four inches, the rotator 40 may be rotated at a rotating speed that prevents ink from being ejected from the print heads 1 and moves the other end of the partition member 50 from position A to position A', during the time from the start to the end of wiping ink off the nozzle surfaces 1*a*, similar to the above embodiment described in conjunction with four print heads 1 provided for the inkjet printer 101. If the length of the print head 1 is, for example, eight inches, the rotator 40 may be rotated at a rotating speed that prevents ink from being ejected from the print heads 1 and rotates the other end of the partition member 50 once from position A, during the time from the start to the end of wiping ink off the nozzle surfaces 1*a*, similar to the above embodiment described in conjunction with eight print heads 1 provided for the printer 101. With such a structure, ink adhered to the nozzle surfaces 1*a* is prevented from flowing back to the head bodies 70 from the ejection nozzles, similar to the above-described embodiment. Therefore, the entry of dust, air bubbles, or other contaminants trapped in ink, which adhere to the nozzle surfaces 1*a*, into the head bodies 70 can be prevented.

In the inkjet printer 101 according to the embodiment, four pumps 30, which are connected to the four print heads 1 in a one-to-one correspondence, are rotated at the substantially same time, to eject or purge ink from the print heads 1 at substantially the same time. Thereafter, ink adhered to the nozzle surfaces 1*a* is wiped at a time by the maintenance unit 117. However, the purging and wiping (maintenance) are not limited to the above-described manner. For example, ink may be purged sequentially from each of the print heads 1, and then ink adhered to the nozzle surfaces 1*a* may be wiped at a time by the maintenance unit 117. Instead, ink may be purged from one of the print heads 1, and then ink adhered to the nozzle surface 1*a* of the pint head 1 may be wiped by the maintenance unit 117. Similarly, the purging and wiping (maintenance) may be performed for the rest of the print heads 1. When ink is wiped off the nozzle surface 1*a*, the pump 30 is rotated slowly enough to prevent ink from being ejected from the ejection nozzles, or the partition member 50 is placed in the stop position. Thus, ink purged from the ejection nozzles and adhered to the nozzle surface 1*a* is prevented from flowing back from the ejection nozzles to the print head 1 before the ink is wiped off the nozzle surface 1*a*. Accordingly, ink ejection failures can be prevented.

If ink is purged sequentially from each of the print heads 1, the maintenance unit 117 may include only the blade 132 and one cap 116. In this case, the maintenance unit 117 may be reduced in size.

While the embodiment of the invention is described in detail, those skilled in the art will recognize that there are many possible modifications and variations which may be made in the embodiment.

For example, the pump 30 of the printer 101 may not have to have the cut portion 42. With this structure, when the other end of the partition member 50 is moved from position' A to position B during the wiping of ink off the nozzle surfaces 1*a* by the maintenance unit 117, the rotating speed of the rotor 40 may not have to be increased, because the cut portion 42 is not located in the chamber divided by the partition member 50 in the hollow 32 and communicating with both the suction inlet 31*a* and the discharge outlet 31*b*. Even when ink in the ink cartridge 20 is reduced, the rotating speed of the rotor 40 may not have to be increased. The print head 1 according to the embodiment is for line printers that do not move in a sheet width direction. However, the invention may be applied to print heads for serial printers that move in the sheet width direction.

What is claimed is:

1. An inkjet printer for ejecting ink, comprising:

an ink tank for storing the ink therein;

a print head that ejects the ink therefrom;

a pump that includes:

a housing having a hollow interior, the housing being formed with an ink suction inlet through which the hollow interior and the ink tank communicate with each other and an ink discharge outlet through which the hollow interior and the print head communicate with each other;

a rotor rotatably disposed in the hollow interior; and a partition member that is supported by the rotor and rotatable together with the rotor, two ends of the partition member contacting a wall surface defining the hollow interior;

a pump drive mechanism that rotates the rotor of the pump; and a control unit that performs a first control for controlling the pump drive mechanism to rotate the rotor at a rotating speed in which ink is supplied from the ink tank to the print head through the pump and ejected from the print head, and a second control for controlling the pump drive mechanism to rotate the rotor at a rotating speed in which ink is not ejected from the print head.

2. The inkjet printer according to claim 1, further comprising:

a removing unit that removes the ink adhered to an ink ejection surface of the print head; and a movement mechanism that moves the print head and the removing unit relative to each other;

wherein the control unit performs a third control for controlling the movement mechanism to move the print head and the removing unit relative to each other to remove the ink adhered to the ink ejection surface of the print head by the removing unit, and performs the second control while performing the third control.

3. The inkjet printer according to claim 2, further comprising a pressure sensor that measures ink pressure in the print head, wherein the control unit performs the second control to reduce the ink pressure measured by the pressure sensor to within a predetermined range.

4. The inkjet printer according to claim 2, further comprising a residual ink amount detecting unit that detects a residual ink amount in the ink tank, wherein the control unit increases the rotating speed of the rotor when performing the second control, as the residual ink amount detected by the residual ink amount detecting unit is reduced.

5. The inkjet printer according to claim 1, wherein the hollow interior is of substantially a cylindrical shape, a rotating axis of the rotor is shifted from a central axis of the cylindrical hollow interior, and the partition member is an elastic member and slidably supported relative to the rotor.

6. The inkjet printer according to claim 5, wherein the rotor is rotatable with a periphery of the rotor making contact with a specified position of the wall surface defining the hollow interior of the housing, and when the periphery of the rotor is making contact with the specified position, the hollow interior of the housing is divided into a chamber communicating with the ink suction inlet, a chamber communicating with the ink discharge outlet, and a chamber not communicating with the ink suction inlet or the ink discharge outlet.

7. A method for controlling an inkjet printer including an ink tank for storing ink therein, a print head that ejects the ink therefrom, and a pump that includes a housing having a hollow interior, the housing being formed with an ink suction inlet through which the hollow interior and the ink tank communicate with each other and an ink discharge outlet through which the hollow interior and the print head communicate with each other, a rotor rotatably disposed in the hollow interior, and a partition member that is supported by the rotor and rotatable together with the rotor, two ends of the partition member contacting a wall surface defining the hollow interior, the method comprising:

a first step for rotating the rotor at a rotating speed in which ink is supplied from the ink tank to the print head through the pump and ejected from the print head; and a second step for rotating the rotor at a rotating speed in which ink is not ejected from the print head.

8. The method according claim 7, further comprising a third step for removing the ink adhered to an ink ejection surface of the print head, wherein the third step is performed concurrently with the second step.

9. The method according claim 8, wherein the rotor is rotated in the second step to reduce ink pressure in the print head to within a predetermined range.

10. The method according claim 8, wherein the rotating speed of the rotor is increased in the second step as a residual ink amount in the ink tank is reduced.

* * * * *